US008351807B2

(12) United States Patent
Seki

(10) Patent No.: US 8,351,807 B2
(45) Date of Patent: Jan. 8, 2013

(54) FIXING UNIT INCLUDING HEATING AREA ADJUSTOR AND IMAGE FORMING APPARATUS USING SAME

(75) Inventor: Takayuki Seki, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 443 days.

(21) Appl. No.: 12/585,231

(22) Filed: Sep. 9, 2009

(65) Prior Publication Data

US 2010/0067929 A1 Mar. 18, 2010

(30) Foreign Application Priority Data

Sep. 11, 2008 (JP) ..... 2008-233550

(51) Int. Cl.
*G03G 15/00* (2006.01)
*G03G 15/20* (2006.01)

(52) U.S. Cl. ..... 399/45; 399/67; 399/334

(58) Field of Classification Search ..... 399/45, 399/67, 69, 328, 329, 334
See application file for complete search history.

(56) References Cited

U.S. PATENT DOCUMENTS

| | | | | |
|---|---|---|---|---|
| 5,625,442 | A | 4/1997 | Seki | |
| 5,749,037 | A | 5/1998 | Takayuki | |
| 5,832,354 | A | 11/1998 | Kouno et al. | |
| 5,915,147 | A | 6/1999 | Kouno et al. | |
| 5,970,298 | A | 10/1999 | Seki et al. | |
| 6,305,636 | B1 | 10/2001 | Satoh et al. | |
| 6,694,121 | B2 | 2/2004 | Seki | |
| 7,433,639 | B2 * | 10/2008 | Yasuda et al. | 399/329 |
| 7,450,872 | B2 * | 11/2008 | Ueno et al. | 399/69 |
| 7,890,042 | B2 * | 2/2011 | Ishida et al. | 399/329 |
| 7,949,290 | B2 * | 5/2011 | Yoshikawa | 399/328 |

FOREIGN PATENT DOCUMENTS

| | | |
|---|---|---|
| JP | 7-287460 | 10/1995 |
| JP | 2001-209266 | 8/2001 |
| JP | 2002-132080 | 5/2002 |
| JP | 2004-145368 | 5/2004 |
| JP | 2004-205877 | 7/2004 |
| JP | 2005-17757 | 1/2005 |
| JP | 2005-189268 | 7/2005 |
| JP | 2005-338724 | 12/2005 |
| JP | 2006-220950 | 8/2006 |
| JP | 2006-243497 | 9/2006 |
| JP | 2006-251479 | 9/2006 |
| JP | 2006-267420 | 10/2006 |
| JP | 2007-58249 | 3/2007 |
| JP | 2007-121469 | 5/2007 |
| JP | 2007-163794 | 6/2007 |
| JP | 2007-171694 | 7/2007 |
| JP | 2007-171749 | 7/2007 |
| JP | 2007-334205 | 12/2007 |

* cited by examiner

*Primary Examiner* — William J Royer
(74) *Attorney, Agent, or Firm* — Harness, Dickey & Pierce, P.L.C.

(57) ABSTRACT

A fixing unit includes a fixing member, a pressing member, a heating device, a sheet width detector, and a heating area adjustor. The pressing member faces the fixing member to form a fixing nip between the fixing member. An un-fixed toner image is fixed on a recording medium when the recording medium passes through the fixing nip. The heating device heats the fixing member while maintaining a non-contact condition with the fixing member. The sheet width detector detects sheet width of the recording medium. The heating area adjustor changes a heating area of the fixing member, heatable by the heating device, based on the sheet width detected by the sheet width detector. The heating area adjustor is moveable in a space between the fixing member and the heating device along a sheet width direction to change a size of the heating area.

35 Claims, 9 Drawing Sheets

FIXING UNIT INCLUDING HEATING AREA ADJUSTOR AND IMAGE FORMING APPARATUS USING SAME

CROSS-REFERENCE TO RELATED APPLICATIONS

This application claims priority to Japanese Patent Application No. 2008-233550, filed on Sep. 11, 2008, in the Japan Patent Office, the entire contents of which are hereby incorporated by reference herein.

BACKGROUND OF THE INVENTION

1. Field of the Invention

The present invention relates to an image forming apparatus employing a fixing unit for fixing a toner image transferred onto a recording medium (e.g., transfer sheet).

2. Description of the Background Art

Typically, image forming apparatuses using electrophotography employ a fixing unit using heat and pressure to fix images on recording media. The fixing unit includes a fixing belt having a heat source therein and a pressure roller, with the fixing belt and the pressure roller forming a pressing portion (or nip portion) therebetween. When a transfer sheet having an un-fixed toner image thereon passes the nip portion, the fixing belt and the pressure roller apply heat and pressure to the un-fixed toner image to fix the toner image on the transfer sheet.

Such image forming apparatuses may use various sizes of transfer sheets such as A4, A3, or the like as a recording medium. However, the fixing belt has a given belt width, and accordingly, continuous image formation on transfer sheets sized narrower than the fixing belt can result in an uneven heat distribution between a center portion and edge portions of the fixing belt. This uneven heat distribution arises because, in the fixing unit, the fixing belt is heated by the heat source, by which the fixing belt receives heat energy. If small-sized transfer sheets are used, such transfer sheets may pass the center portion of the fixing belt but not the edge portions of the fixing belt. If such condition occurs, heat energy at the center portion of fixing belt is consumed but heat energy at the edge portions of the fixing belt is not consumed, by which temperature increases significantly at the edge portions of the fixing belt. Such significant temperature increase at the edge portion of fixing belt may accelerate deterioration of a surface layer of the fixing belt and of the pressure roller, ultimately resulting in defective images.

Further, in such fixing unit, heat energy may not be effectively and efficiently used because heat energy of the heat source is supplied to an area that a transfer sheet is passing (referred to as sheet-pass area), and also supplied to an area that a transfer sheet is not passing through (referred to as sheet-not-pass area).

In light of such heat energy issue, JP-2006-267420-A discusses another type of fixing unit having a heat roller and a pressure roller. The heat roller includes a heat source (e.g., halogen lamp), a rotatable light-shield member having a cylindrical shape that encloses the halogen lamp, a fixed sleeve disposed outside of the rotatable light-shield member, and a rotatable sleeve disposed outside of the fixed sleeve. The fixed sleeve has a rectangular-shaped slit extending in an axial direction (or width direction) of the heat roller, and the rotatable light-shield member has a triangular-shaped slit having one side extended in the axial direction of heat roller.

With such a configuration, a window can be set by aligning the rectangular-shaped slit and triangular-shaped slit by rotating the rotatable light-shield member to a given angle. A size of the window may be adjusted in view of the sheet width of the transfer sheet. Light emitted from the halogen lamp passes through the adjustable window and irradiates an inner face of the rotatable sleeve, which is a heating area (or sheet-pass area).

However, in such fixing unit, the fixed sleeve and the rotatable light-shield member are interposed between the heat source and the rotatable sleeve. Accordingly, much of the heat energy of the heat source may be absorbed by the fixed sleeve and the rotatable light-shield member, and thereby heat energy may not be effectively and efficiently used to heat the rotatable sleeve.

Further, a height of the rectangular-shaped slit in a sheet transport direction is set smaller than a width of the triangular-shaped slit in the sheet transport direction to adjust the size of the window in a sheet width direction. Accordingly, there is a limit on the size of the window in the sheet transport direction, which is perpendicular to the sheet width direction.

Further, because the size of the above-mentioned window in the sheet transport direction is limited, heat energy to heat the rotatable sleeve may need to be increased by using a heat source having a larger heat generating capacity. However, such larger capacity may unfavorably increase both the size of the fixing unit and an energy consumption level.

SUMMARY

In one aspect of the present invention, a fixing unit is devised. The fixing unit includes a fixing member, a pressing member, a heating device, a sheet width detector, and a heating area adjustor. The pressing member faces the fixing member to form a fixing nip between the fixing member. An un-fixed toner image is fixed on a recording medium when the recording medium passes through the fixing nip. The heating device heats the fixing member while maintaining a non-contact condition with a surface of the fixing member. The sheet width detector detects sheet width of the recording medium to pass through the fixing nip. The heating area adjustor changes a heating area of the fixing member, heatable by the heating device, based on the sheet width detected by the sheet width detector. The heating area adjustor is moveable in a space between the fixing member and the heating device along a sheet width direction to change a size of the heating area.

In another aspect of the present invention, an image forming apparatus is devised. The image forming apparatus includes an image forming unit and a fixing unit. The image forming unit forms an un-fixed toner image on a recording medium. The fixing unit fixes the un-fixed toner image on the recording medium. The fixing unit includes a fixing member, a pressing member, a heating device, a sheet width detector, and a heating area adjustor. The pressing member faces the fixing member to form a fixing nip between the fixing member. An un-fixed toner image is fixed on a recording medium when the recording medium passes through the fixing nip. The heating device heats the fixing member while maintaining a non-contact condition with a surface of the fixing member. The sheet width detector detects sheet width of the recording medium to pass through the fixing nip. The heating area adjustor changes a heating area of the fixing member, heatable by the heating device, based on the sheet width detected by the sheet width detector. The heating area adjustor is moveable in a space between the fixing member and the heating device along a sheet width direction to change a size of the heating area.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 6 illustrates a cross-sectional view of a fixing unit according to a second example embodiment;

Figure 1:
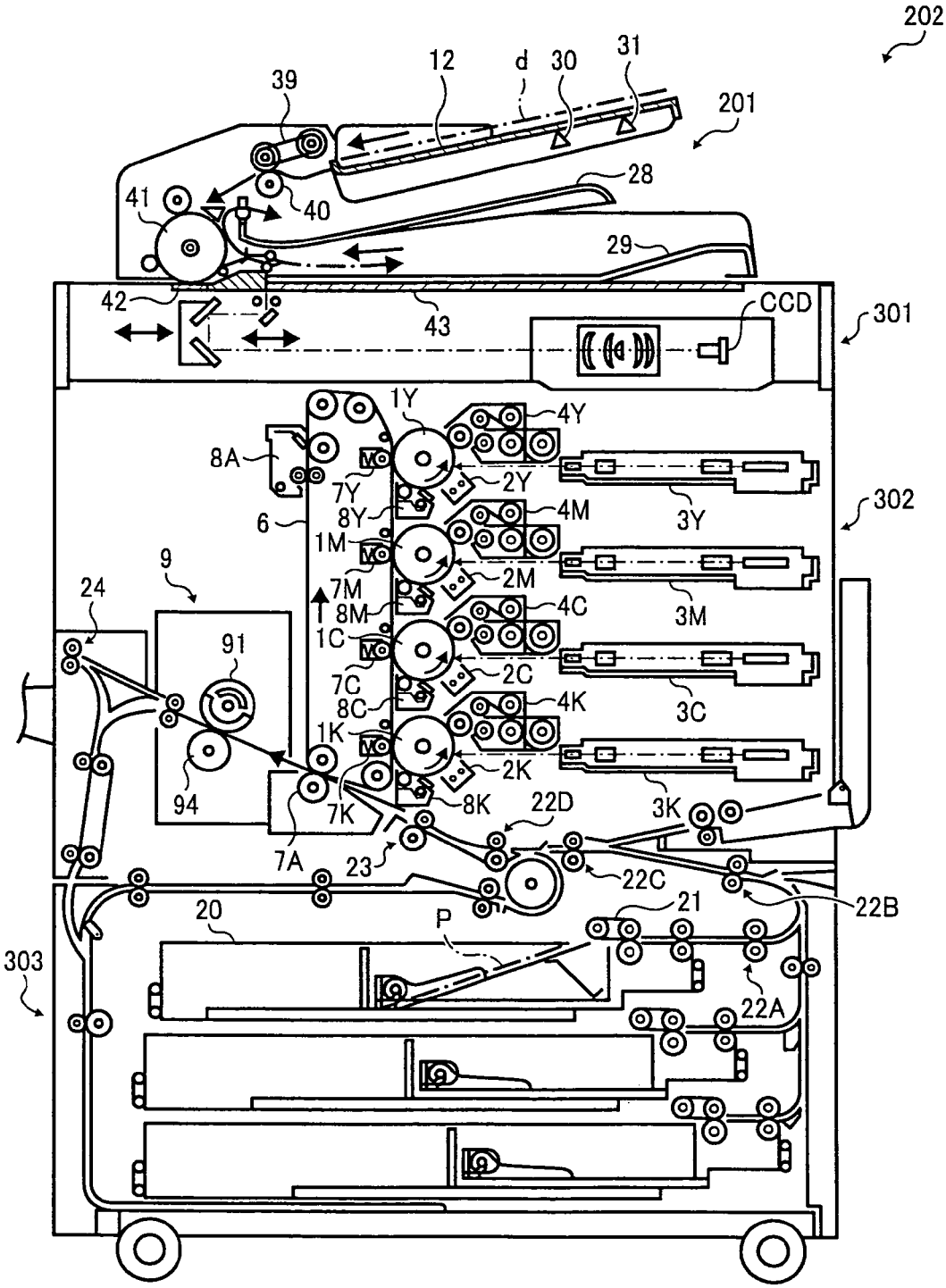
FIG. 1 illustrates a schematic configuration of an image forming apparatus according to a first example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, and the like may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus employing a fixing unit according to an exemplary embodiment is described. The image forming apparatus may be a copier employing an electrophotographic system, for example, but not limited thereto.

Figure 2:
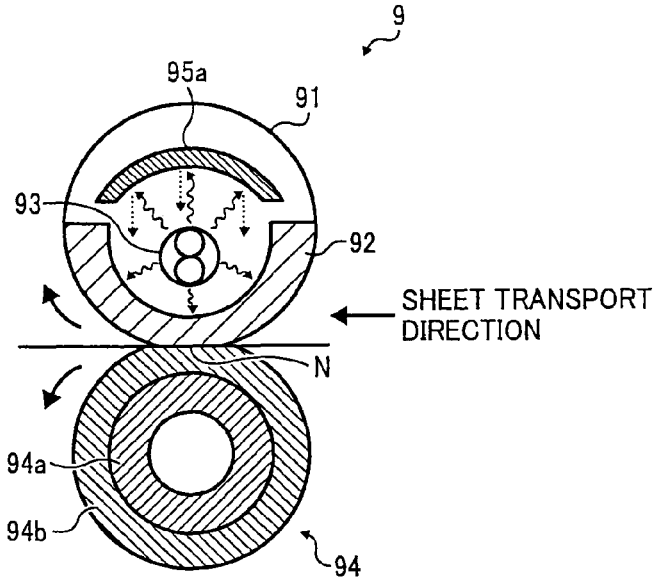
FIG. 2 illustrates a cross-sectional view of a fixing unit according to a first example embodiment.
Figure 3A:
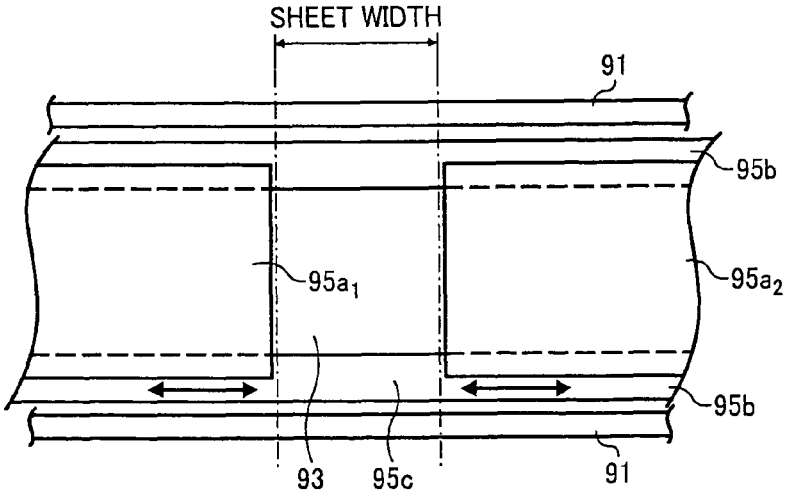
FIGS. 3A and 3B illustrate a plan view and a cross-sectional view of a shield member.
Figure 3B:
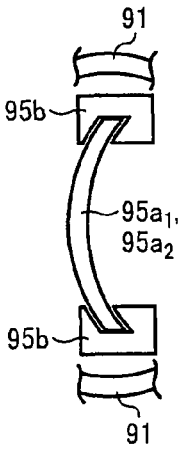
Figure 4A:
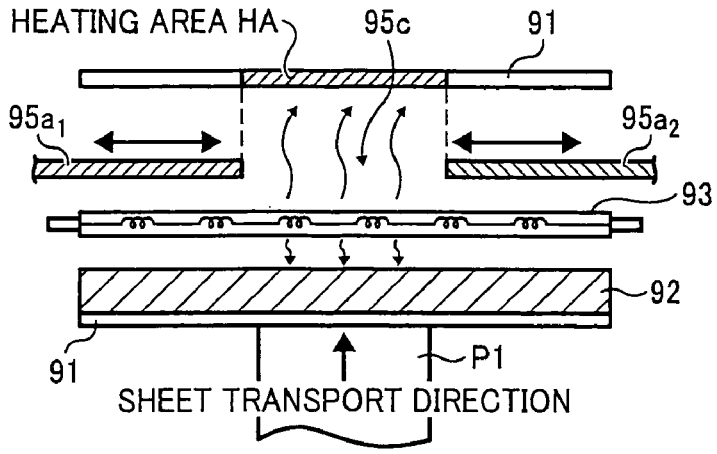
FIGS. 4A-4C illustrate movement of a shield member.
Figure 4B:
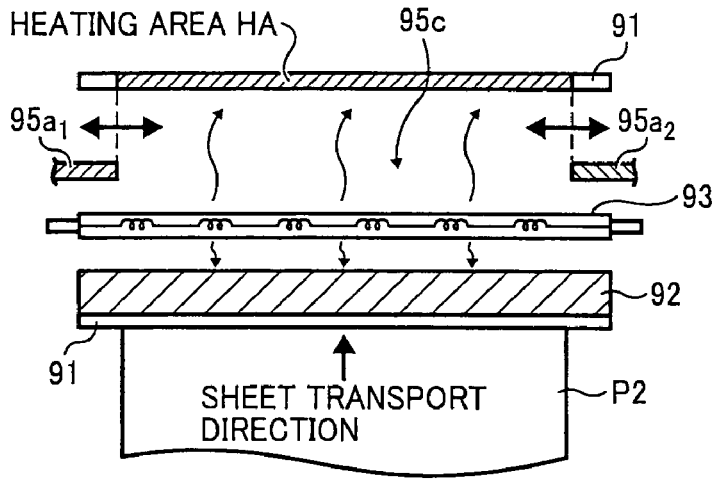
Figure 4C:
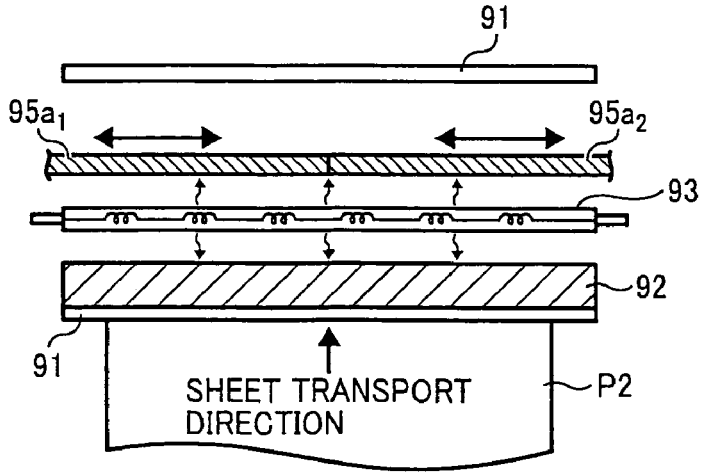
Figure 5:
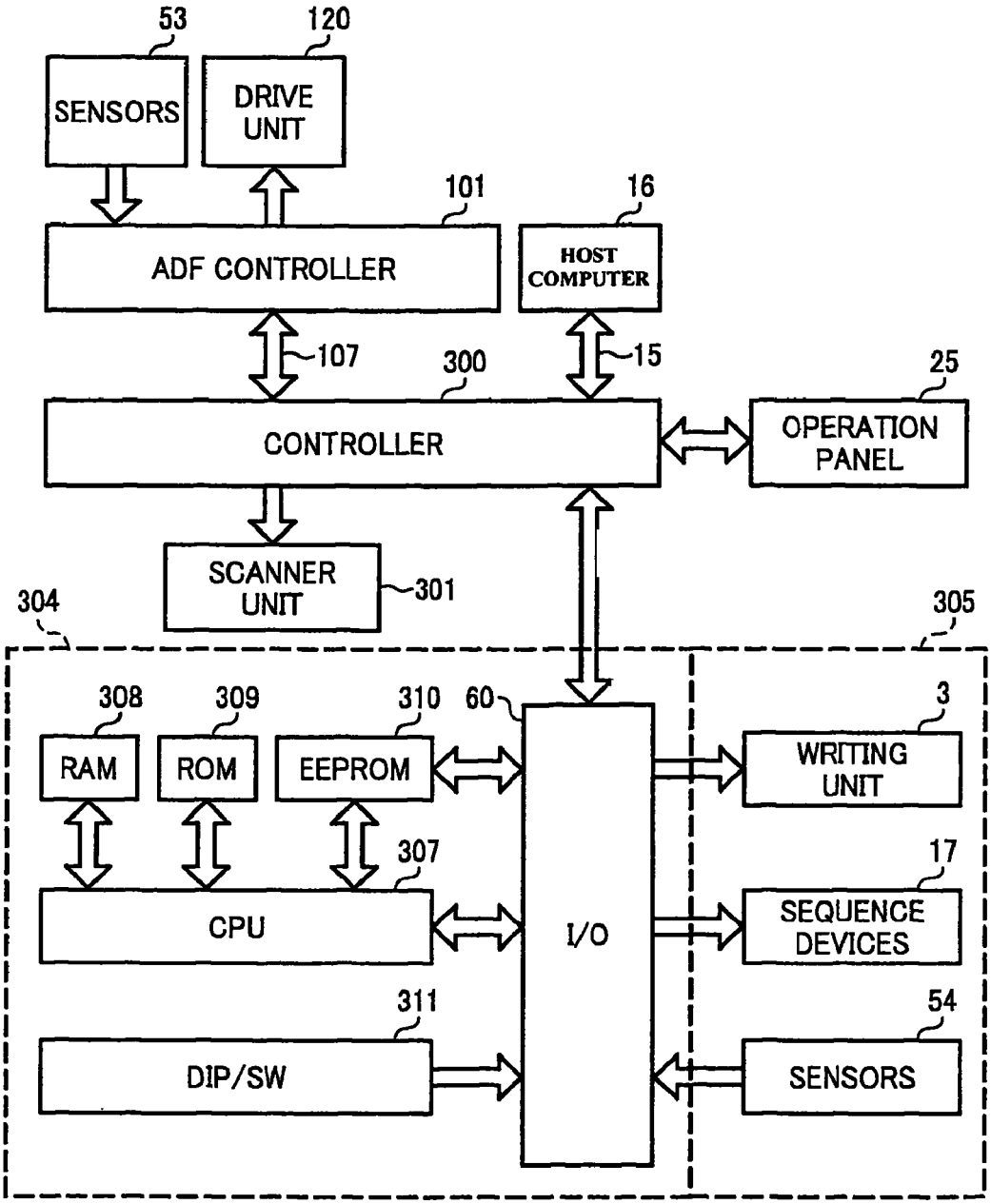
FIG. 5 shows a block diagram of a control system of the image forming apparatus of FIG. 1.

FIGS. 1 to 5 show an image forming apparatus according to a first example embodiment. FIG. 1 illustrates a schematic configuration of an image forming apparatus 202 according to a first example embodiment. FIG. 2 illustrates a cross-sectional view of a fixing unit 9 according to a first example embodiment. FIGS. 3A and 3B illustrate a plan view and cross-sectional view of a shield member according to a first example embodiment. FIGS. 4A-4C illustrate movement of a shield member according to a first example embodiment. FIG. 5 shows a block diagram of a control system of the image forming apparatus 202 of FIG. 1.

As shown in FIG. 1, the image forming apparatus 202 includes a contact glass 43 and a slit glass 42 on an upper side of the image forming apparatus 202. The contact glass 43 is made of transparent material, and the slit glass 42 made of transparent material is disposed next to the contact glass 43. The slit glass 42 has a smaller area compared to the contact glass 43.

Further, the image forming apparatus 202 includes an automatic document feeder 201 (ADF 201) over its upper side. The ADF 201 is pivotably opened and closed with respect to the contact glass 43 using a hinge mechanism, for example.

The ADF 201 feeds a document sheet d placed on a document table 12 one by one to a document scanning position, and ejects the scanned document sheet d to document ejection trays 28 and 29. Specifically, a sheet feed belt 39 and a separation roller 40 separate and feed the document sheet d from the document table 12 one by one. A transport roller such as an inverting roller 41 transports the document sheet d to the document scanning position on the slit glass 42.

Further, document length sensors 30 and 31 may be disposed to detect a length of the document sheet d in a transport direction. The document length sensors 30 and 31 may be a reflection type sensor or an actuator type sensor, which can detect a single sheet.

An ADF controller 101 (see FIG. 5) determines an orientation of document sheet d by referring signals coming from the document length sensors 30 and 31. For example, the ADF controller 101 determines whether a document sheet d is transported in a portrait direction or landscape direction.

The image forming apparatus 202 includes a scanner unit 301 under the contact glass 43, an image forming device 302, and a sheet feeding device 303. The scanner unit 301 is used as an image reading (or scanning) unit. The scanner unit 301 may employ an optical system, which compresses light information using a charge coupled device (CCD) image sensor, for example. Image information scanned by the scanner unit 301 is converted to electrical signals for each of colors Y(yellow), M(magenta), C(cyan), and K(black), and the electrical signals are converted to light beams by a writing unit 3 (see FIG. 5) for each of the colors. The light beams are irradiated onto photoconductor drums 1Y, 1M, 1C, and 1K.

The scanner unit 301 may include a light source, a first mirror, a second mirror, a third mirror, a focus lens, and a CCD image sensor, for example. The light source irradiates light to the document sheet d placed on the contact glass 43 or the slit glass 42. The first mirror, second mirror, and third mirror reflect light reflected from the document sheet d. The focus lens focuses light reflected from the third mirror on the CCD image sensor. The CCD image sensor converts the light focused by the focus lens to electric signals.

The light source and the first mirror are installed in a first carriage, and the second mirror and the third mirror are installed in a second carriage. The first carriage and the second carriage are movable in a left to right direction and vice versa in FIG. 1 under the contact glass 43 and the slit glass 42 along a guide rail supporting the first carriage and the second carriage.

The first carriage and the second carriage move under the contact glass 43 when scanning a document sheet d placed on the contact glass 43. The first carriage and the second carriage are set still under the slit glass 42 when to scan a document sheet d passing the slit glass 42. The scanner unit 301 can scan an image on a document such as characters, text, figures, photos, or the like.

Optical writing units 3Y, 3M, 3C and 3K respectively irradiate laser beams of each color to the charged photoconductor drums 1Y, 1M, 1C, and 1K, wherein the laser beams are generated based on the image information scanned by the scanner unit 301.

Each of the photoconductor drums 1Y, 1M, 1C, and 1K is surrounded by development units 4Y, 4M, 4C, and 4K, an intermediate transfer belt 6, cleaning units 8Y, 8M, 8C, and 8K, charge units 2Y, 2M, 2C, and 2K, and de-charge units 7Y, 7M, 7C, and 7K, for example. Such photoconductor drums and the surrounding units may configure an image forming unit.

The charge units 2Y, 2M, 2C, and 2K charge the surface of the photoconductor drums 1Y, 1M, 1C, and 1K at a given uniform potential. For example, the charge units 2Y, 2M, 2C, and 2K uses corona discharge of positive charge, controlled by a grid.

The optical writing units 3Y, 3M, 3C, and 3K irradiate laser beams onto the uniformly charged photoconductor drums 1Y, 1M, 1C, and 1K to erase negative charges on the photoconductor drums 1Y, 1M, 1C, and 1K, by which an electrostatic latent image is formed on each of the photoconductor drums 1Y, 1M, 1C, and 1K. The laser beams are generated based on scanned image information.

The development units 4Y, 4M, 4C, and 4K supply negatively-charged toner particles to the negative-charge-erased portion of the photoconductor drums 1Y, 1M, 1C, and 1K to form toner images on the photoconductor drums 1Y, 1M, 1C, and 1K. The toner images formed on the photoconductor drums 1Y, 1M, 1C, and 1K may be referred to as an un-fixed toner image.

The intermediate transfer belt 6 is applied with a positive bias voltage. Negatively-charged toner images are transferred from the photoconductor drums 1Y, 1M, 1C, and 1K to the intermediate transfer belt 6, and then the toner images are transferred to a transfer sheet used as a recording medium.

Each of the cleaning units 8Y, 8M, 8C and 8K may include a cleaning blade to scrape toner particles remaining on the photoconductor drums 1Y, 1M, 1C, and 1K.

The de-charge unit erase charges remaining on the photoconductor drums 1Y, 1M, 1C, and 1K by lighting an LED to prepare the photoconductor drums 1Y, 1M, 1C, and 1K for a new image forming process.

Further, the image forming apparatus 202 includes sheet holders 20 to store transfer sheet P, which may have different sizes. The transfer sheet P, stored in the sheet holder 20, can be fed by a sheet feed belt 21, and separated from the sheet feed belt 21 using a reverse roller, which contacts from the sheet feed belt 21 and rotates in a separation direction.

The separated transfer sheet P is transported to a registration roller 23 using sheet feed rollers 22A, 22B, 22C, and 22D. The registration roller 23 feeds the transfer sheet P to a nip portion set between a transfer roller 7A and the intermediate transfer belt 6 at a given timing. At the nip portion, the un-fixed toner image is transferred from the intermediate transfer belt 6 to the transfer sheet P. The area of the intermediate transfer belt 6 from which the un-fixed toner image is transferred is then rotated toward the belt cleaning unit 8A.

The transfer sheet P transferred with the un-fixed toner image is transported to a fixing unit 9. In the fixing unit 9, toner is melted to fix the un-fixed toner image on the transfer sheet P. The fixing unit 9 may include a fixing belt 91 having a heat source 93 therein (see FIG. 2), and a pressure roller 94, for example, and the fixing belt 91 and pressure roller 94 form a nip N (see FIG. 2) therebetween. Accordingly, a fixing process applying heat and pressure to the transfer sheet P, which is passing the nip N, is conducted.

As shown in FIG. 2, the fixing unit 9 may include the fixing belt 91 and the pressure roller 94, for example. The fixing belt 91 may rotate in a given rotation direction with an external roller when the external roller rotates. The pressure roller 94, which may be driven in a given rotation direction by a drive unit, may be contacted to the fixing belt 91.

The fixing belt 91 may be an endless belt having flexibility, and the fixing belt 91 may slidably move on a heat conductor 92, fixed inside the fixing belt 91. The pressure roller 94 has an elastic layer 94*b* pressed to the fixing belt 91. The pressure roller 94 has a given axial length, which may be set smaller than an axial length of the fixing belt 91. The fixing belt 91 and the pressure roller 94 form the nip N therebetween, wherein the nip N may be a contact portion of the fixing belt 91 and the pressure roller 94, which can be assumed as a flat faced portion.

The fixing belt 91 may be formed as a metal belt using metal such as nickel, stainless steel (SUS), or the like. Further, the fixing belt 91 may be formed of heat-resistance resin material such as heat-resistance rubber, polyimide, or the like. The fixing belt 91 may have a separation layer as a surface layer formed of PFA (perfluoroalkoxy) resin layer, PTFE (polytetrafluoroethylene) resin layer, for example. Such separation layer has a function of preventing toner adherence to the fixing belt 91 from the un-fixed toner on the transfer sheet P.

Further, the fixing belt 91 may include the heat source 93, a shield member 95*a*, and the heat conductor 92. The heat source 93 may be a heater, for example. The shield member 95*a* is used to set a window corresponding to a heating area HA of the fixing belt 91 (see FIGS. 4A and 4B) heatable by the heat source 93. The heat conductor 92 is used to conduct radiant heat of the heat source 93 to the fixing belt 91, and to press the fixing belt 91 to the pressure roller 94. The inner face of the fixing belt 91 may be colored in black to absorb radiant heat of the heat source 93 efficiently, for example.

As shown in FIG. 3A, the shield member 95*a* may include two shield members 95*a*1 and 95*a*2, for example, and both of the shield members 95*a*1 and 95*a*2 can be moved in a sheet width direction. The shield members 95*a*1 and 95*a*2 may be made of aluminum-based material, for example, and the shield members 95*a*1 and 95*a*2 may be curved along a curving of the fixing belt 91 as shown in FIG. 3B, wherein the fixing belt 91 may be formed in a curved shape as shown in FIG. 2.

Further, each of the shield members 95*a*1 and 95*a*2 has an upper face and a lower face. The lower face (the lower face in FIG. 2) faces the heat source 93, and the upper face (the upper face in FIG. 2) faces the inner face of fixing belt 91.

The lower face of the shield members 95*a*1 and 95*a*2 may be set as a reflection face formed of aluminum-based material, for example, and the reflection face has given heat reflectivity (or reflectance). For example, the reflection face has heat reflectivity (or reflectance) of 95% or more, for example.

Further, the upper face may be formed as a heat-resistance layer such as a heat-resistance resin layer, a heat-resistance rubber layer, or a ceramic layer, for example. Such heat-resistance layer may include a "vacuum insulation layer" in its inside. Such vacuum insulation layer may be set to have an internal pressure of 1/500 or less of atmospheric pressure, for example.

In a configuration shown in FIGS. 3A and 3B, the shield members 95*a*1 and 95*a*2 can be spread apart by moving the shield members 95*a*1 and 95*a*2 in opposite directions, by which a window having a given size can be set between the shield members 95*a*1 and 95*a*2, wherein the window is an opened space. Accordingly, the radiant heat of heat source 93 can be supplied to a heating area HA of the fixing belt 91 through the window. The size and relative position of the window can be adjusted step-wisely. Further, the lower face of the shield members 95*a*1 and 95*a*2 reflect radiant heat of the heat source 93 to the heat conductor 92. As shown in FIGS. 2 and 3B, the shield members 95*a*1 and 95*a*2 may be formed in a curved shape, and the lower face of the shield members 95*a*1 and 95*a*2 may be formed as a concave face, for example.

The heat conductor 92 may be made of material having higher thermal conductivity compared to the fixing belt 91. For example, the heat conductor 92 may be made of aluminum-based material having thermal conductivity of 236 W/m·k. As shown in FIG. 2, the heat conductor 92 may have a curved shape and be fixed at a given position in the fixing belt 91. For example, the heat conductor 92 may have a round-arched shape as shown in FIG. 2.

Further, as shown in FIG. 2, the heat conductor 92 has a first face (the upper face in FIG. 2), which faces the heat source 93 and a part of the inner face of the fixing belt 91, and a second face (the lower face in FIG. 2), which contacts the inner face of the fixing belt 91. Further, the first face (the upper face in FIG. 2) of the heat conductor 92 may be colored in black, for example, to absorb radiant heat of the heat source 93 efficiently.

Although the heat conductor 92 may have a round-arched shape in its cross-section view, the heat conductor 92 may be shaped in another shape. For example, a portion of heat conductor 92 which faces the nip N may be shaped in a flat shape or concave shape, in which, separation performance of transfer sheet P may be enhanced.

Further, a temperature sensor may be disposed near the nip N and outside of the fixing belt 91. Temperature information of the nip N detected by the temperature sensor may be transmitted to a controller 300 (see FIG. 5).

The pressure roller 94 includes a metal roller 94*a*, and the elastic layer 94*b* formed on the metal roller 94*a*. The elastic layer 94*b* may be made of, for example, silicone rubber. The surface of the elastic layer 94*b* may be formed of fluorinated resin (e.g., PFA resin, PTFE resin) to set a given separation performance. The pressure roller 94 may be rotated in a counter-clockwise direction in FIG. 2, wherein the pressure roller 94 is driven by a drive motor (or driving force source) linked to the pressure roller 94 via a drive force transmission unit including a gear, a pulley, or the like. Further, the pressure roller 94 may be pressed to the fixing belt 91 using a spring or the like, and the elastic layer 94*b* is deformed against the fixing belt 91, by which the nip N having a given nip width is formed.

As shown in FIGS. 3A and 3B, two guide rails 95*b*, extending in the sheet width direction, may be disposed in the fixing belt 91. The shield members 95*a*1 and 95*a*2 can be moved in the sheet width direction (to left or right direction in FIG. 3A) with a guide effect of the guide rails 95*b*. Each of the shield members 95*a*1 and 95*a*2 may be moved in the sheet width direction by using a given drive unit. For example, such given drive unit may be a solenoid unit having a magnet coil, a plunger, or the like disposed for each of the shield members 95*a*1 and 95*a*2. By activating or de-activating the solenoid units (e.g., ON/OFF of solenoid), the shield members 95*a*1 and 95*a*2 can be spread apart, by which a window 95*c* can be set between the shield members 95*a*1 and 95*a*2, which is spread apart.

Because the two guide rails 95*b* are disposed in parallel with each other, a length size of the window 95*c* in the sheet transport direction can be set to a constant value. On one hand, a length size of the window 95*c* in the sheet width direction can be changed by adjusting moving distance of the shield members 95*a*1 and 95*a*2. Further, the two guide rails 95*b* may be disposed with a stopper (e.g., convex member) in a groove of the guide rails 95*b* to prevent a clash damage of the shield members 95*a*1 and 95*a*2 when the window 95*c* is closed.

In such configuration, the length size=of the window 95*c* in the sheet width direction is set greater than the sheet width of the transfer sheet P, which passes the nip N. Accordingly, when the inner face of the fixing belt 91 is heated by radiant heat of the heat source 93 through the window 95*c*, the size of the heating area HA (see FIGS. 4A-4C) in the sheet width direction, heatable by radiant heat, may be set greater than the sheet width. The heating area HA is directly supplied with radiant heat from the heat source 93 through the window 95*c*, and the heating area HA is a part of the inner face of fixing belt 91. Further, the transfer sheet P passes through the nip N having a given length, which is sufficient for the sheet width of transfer sheet P.

As shown in FIG. 4A, when a transfer sheet P1 of small size (e.g., smallest size) is transported, the shield members 95*a*1 and 95*a*2 is moved and spread apart in opposite directions in the sheet width direction by activating the solenoid units to set a given size of the window 95*c* for small size sheet. The radiant heat of heat source 93 can be supplied to the heating area HA of the inner face of the fixing belt 91 through the window 95*c*.

The length size of the window 95*c* in the sheet width direction is set greater than a sheet width of the transfer sheet P1, by which the size of the heating area HA in the sheet width direction set for the inner face of the fixing belt 91 is set greater than the sheet width of transfer sheet P1. Accordingly, heat can be supplied effectively to the edge portion of the heating area HA in the sheet width direction, by which the transfer sheet P1 can be heated uniformly.

As shown in FIG. 4B, when a transfer sheet P2 of large size (e.g., largest size) is transported, the shield members 95*a*1 and 95*a*2 are moved and spread apart in opposite directions in the sheet width direction by activating the solenoid units to set a given size of the window 95*c* for large size sheet. The radiant heat of heat source 93 can be supplied to the heating area HA of the inner face of the fixing belt 91 through the window 95*c*.

The length size of the window 95*c* in the sheet width direction is set greater than a sheet width of the transfer sheet P2, by which the length size of the heating area HA in the sheet width direction for the inner face of the fixing belt 91 is set greater than the sheet width of transfer sheet P2. Accordingly, heat can be supplied effectively to the edge portion of the heating area HA in the sheet width direction, by which the transfer sheet P2 can be heated uniformly.

In FIGS. 4A and 4B, as the fixing belt 91 rotates toward the nip N (or the heat conductor 92), different portions of the fixing belt 91 can be heated successively, by which an area of the heating area HA becomes greater in a direction perpendicular to the sheet width direction.

Further, at a portion where the window is not set, the radiant heat of heat source 93 is supplied to the lower face of the shield members 95*a*1 and 95*a*2. Some of the radiant heat is then reflected by the lower face of the shield members 95*a*1 and 95*a*2, and then supplied to the heat conductor 92. Further, the radiant heat of heat source 93 can be directly supplied to the heat conductor 92. Then, the heat energy supplied to the heat conductor 92 can be transmitted to the fixing belt 91 via a contact portion of the heat conductor 92 and the fixing belt 91 (including the nip N).

Further, FIG. 4C shows another configuration when the transfer sheet P2 of large size is transported. As shown in FIG. 4C, when the transfer sheet P2 of large size is transported, the shield members 95*a*1 and 95*a*2 may not be moved by deactivating the solenoid unit, by which the shield members 95*a*1 and 95*a*2 may be set to a contacted and closed condition, in which the window 95*c* is closed, and thereby no window is set. In this case, because the window 95*c* is not set, the radiant heat of heat source 93 is not supplied to the inner face of the fixing belt 91 (see FIG. 4C) directly through the window 95*c*, by which heating area HA is not set for the fixing belt 91. Instead, the radiant heat of heat source 93 may be supplied to the shield members 95*a*1 and 95*a*2, and the heat conductor 92. Then, some of the supplied radiant heat is reflected by the lower face of the shield members 95*a*1 and 95*a*2, and then supplied to the heat conductor 92. The heat energy supplied to the heat conductor 92 can be transmitted to the fixing belt 91 via a contact portion of the heat conductor 92 and the fixing belt 91 (including the nip N). In such configuration, a length of the heat conductor 92 in the sheet width direction may be set greater than the sheet width of the transfer sheet P2 at least at the nip N.

Accordingly, heat can be supplied effectively to the edge portion of the transfer sheet P2 in the sheet width direction via the fixing belt 91, by which the transfer sheet P2 can be heated uniformly. Further, because the shield members 95*a*1 and 95*a*2 are not moved, a control process for moving the shield members 95*a*1 and 95*a*2 is not required.

As shown in FIG. 5, the image forming apparatus 202 includes a control system, which may include the ADF controller 101, the controller 300, an image forming engine 305, an engine control board 304, and an operation panel 25, for example. The ADF controller 101 controls the ADF 201. The controller 300 controls the image forming apparatus 202. The image forming engine 305 is used for image forming operation. The engine control board 304 is used for controlling the image forming engine 305. The operation panel 25 may be used to set various modes and input operation instructions such as operation-start instructions. The controller 300 and the ADF controller 101 communicate data and control-signals via an interface 107. The controller 300, the image forming engine 305, and the engine control board 304 communicate signals via an input/output interface (I/O) 60 of the engine control board 304. The controller 300 and the scanner unit 301 communicate image data and control signals via an interface.

Further, the image forming engine 305 may include the optical writing unit 3, sequence devices 17, and sensors 54, for example. The optical writing unit 3 includes a laser diode (LD), a polygon motor, or the like. The sequence devices 17 may be used as engine sequence devices for a fixing system, a development system, a driving system, or the like. The sensors 54 check transport condition in a transportation route and condition of sequence. The driving system may include a belt transportation motor to drive a belt roller to rotate the intermediate transfer belt 6, a solenoid unit to move the shield member 95*a* (95*a*1, 95*a*2) in the sheet width direction, for example. The sensors 54 may include the temperature sensor, disposed near the nip N, defined by the fixing belt 91 and the pressure roller 94, to detect the temperature at the nip N.

Further, the engine control board 304 may include a CPU (central processing unit) 307, a RAM (random access memory) 308, a ROM (read only memory) 309, a non-volatile memory 310 (shown as an EEPROM), and a selection switch 311 (referred to DIP/SW 311). The CPU 307 controls the image forming engine 305 as a whole using a program stored in the ROM 309, mode instructions sent from the operation panel 25, and command instructions sent from the controller 300, and other related information. The RAM 308 may be used as a working memory of the CPU 307 or a buffer memory of input data. The ROM 309 stores a control program for the image forming engine 305. The non-volatile memory 310 stores error history data of the image forming engine 305, mode instructions sent from the operation panel 25, or the like. The non-volatile memory 310 may be an EEPROM (electrically erasable programmable read-only memory). The selection switch 311 (DIP/SW 311) is used to set a mode for engine control.

The controller 300 and a host computer 16 are connected via an input/output interface 15, by which the image forming engine 305 and the host computer 16 can communicate data and control signals.

Further, the ADF controller 101 is connected to the sensors 53 (e.g., document length sensors 30 and 31), and a drive unit 120 (e.g., drive motor, motor driver), which drives mechanics of each of the rollers.

The ADF controller 101 transmits a scan timing signal to the scanner unit 301 via the controller 300 by referring signals coming from the sensors 53 and control signals coming from the controller 300 of the image forming apparatus 202. Based on the scan timing signal, the light source is set to ON/OFF for emitting light to the document.

Further, the controller 300 may determine a sheet width of the transfer sheet P, to be printed with an image, based on data coming from the ADF controller 101 or the host computer 16. Further, sheet width information can be input using the operation panel 25.

A description is now given to a control process for image forming in the image forming apparatus 202.

At first, the controller 300 determines whether a start operation is conducted. For example, the controller 300 determines whether a start key of the operation panel 25 is pressed based on signals output from the operation panel 25.

When it is determined that the start key is pressed, the controller 300 determines whether a scan mode is set. For example, the controller 300 determines whether information of a sheet-through scan mode or fixed-sheet scan mode is stored in a memory of the controller 300. When it is determined that the scan mode is set, the controller 300 transmits a scan signal to the ADF controller 101. The scan signal is a control signal for instructing an automatic document transporting and scanning.

On one hand, when it is determined that the scan mode is not set, the controller 300 determines whether a print mode is set. For example, the controller 300 determines whether information of a monochrome print mode or a color print mode is stored in a memory of the controller 300.

When it is determined that the print mode is set, the controller 300 outputs a sheet feed signal to the CPU 307. The sheet feed signal is a control signal for instructing a transportation of the transfer sheet P from the sheet holder 20 to an image forming position (e.g., transfer position). The sheet feed signal may include size information of the transfer sheet P (e.g., sheet width information). The sheet width of transfer sheet P may be determined by the ADF controller 101 based on signals coming from the document length sensors 30 and 31 when the document is scanned, for example, and the ADF controller 101 transmits information of sheet width of the transfer sheet P to the controller 300. Further, information of sheet width of the transfer sheet P may be transmitted to the controller 300 from the operation panel 25 by inputting information using the operation panel 25. Further, information of sheet width of the transfer sheet P may be transmitted to the controller 300 from the host computer 16.

The CPU 307 activates a sheet feed motor via the sequence devices 17 based on the sheet feed signal. By activating the sheet feed motor, the sheet feed belt 21, the sheet feed rollers 22A, 22B, 22C, and 22D, the registration roller 23, or the like can be rotated, by which the transfer sheet P can be fed and transported from the sheet holder 20 to the image forming position.

Further, the controller 300 counts drive pulses of the sheet feed motor to determine transport condition (e.g., transport position, transport speed) of the transfer sheet P based on a counted value of drive pulses and detection signals of the sensors 54. When the transfer sheet P comes to a given position set before the image forming position (e.g., registration position), the controller 300 stops transportation of the transfer sheet P for a while via the CPU 307, and inputs image data to be printed on transfer sheet P to the CPU 307 to execute an image forming process. Such to-be-printed image data may be stored in an image memory of the scanner unit 301, for example, and input to the CPU 307 via the input/output interface 60, or may be input to the CPU 307 from the host computer 16 via the input/output interface 60.

The CPU 307 instructs the optical writing unit 3 to irradiate a laser beam to a surface of each of the photoconductor drums 1Y, 1M, 1C, and 1K, wherein the laser beam is modulated based on image data, by which the exposure process is conducted. By conducting such exposure process, an electrostatic latent image is formed on a surface of each of the photoconductor drums 1Y, 1M, 1C, and 1K. Then, the CPU 307 instructs the development units 4Y, 4M, 4C and 4K to develop the electrostatic latent image as a toner image by transferring toner to the surface of the photoconductor drums 1Y, 1M, 1C, and 1K.

Further, the CPU 307 controls driving of the sheet feed motor to transport the transfer sheet P to the transfer position at a given timing for transferring the toner image on the transfer sheet P. The sheet feed motor drives the sheet feed belt 21, the sheet feed rollers 22A, 22B, 22C, and 22D the registration roller 23, for example. Further, the CPU 307 drives a belt transportation motor at the given timing set for transferring the toner image. The belt transportation motor drives the intermediate transfer belt 6 and the transfer roller 7A.

By driving the sheet feed motor and the belt transportation motor as such, the toner image is transferred to the intermediate transfer belt 6 from the photoconductor drums 1Y, 1M, 1C, and 1K, and the toner image is transferred to the transfer sheet P from the intermediate transfer belt 6 at a nip, set between the intermediate transfer belt 6 and the transfer roller 7A. Such toner image on the transfer sheet P is an un-fixed color toner image. Then, the transfer sheet P having the un-fixed color toner image is transported to the fixing unit 9.

Then, the controller 300 instructs the CPU 307 to conduct the fixing process. The CPU 307 instructs the fixing unit 9 to conduct the fixing process via the sequence devices 17. In the fixing process, the heat source 93 and movement of the shield members 95*a*1 and 95*a*2 may be controlled based on information of size (e.g., sheet width size) of the transfer sheet P. Specifically, the heater of the heat source 93 is set to ON and the shield members 95*a*1 and 95*a*2 are moved and spread apart based on information of size (e.g., sheet width) of the transfer sheet P.

For example, when the fixing process is conducted for the transfer sheet P1 of small size (e.g., smallest size), the shield members 95*a*1 and 95*a*2 are spread apart, and the size of the window 95*c* for the small size sheet in the sheet width direction is set greater than the sheet width of transfer sheet P1 (see FIG. 4A). In such a case, some of the radiant heat of the heat source 93 is supplied directly to the heating area HA of the fixing belt 91 through the window 95*c*. Further, some of the radiant heat of the heat source 93 is reflected by the lower face of the shield members 95*a*1 and 95*a*2, and supplied to the heat conductor 92. Further, some of the radiant heat of the heat source 93 is supplied directly to the heat conductor 92.

On one hand, when the fixing process is conducted for the transfer sheet of P2 of large size (e.g., largest size), the shield members 95*a*1 and 95*a*2 are spread apart, and the size of the window 95*c* for the large size sheet in the sheet width direction is set greater than the sheet width of transfer sheet P2 (see FIG. 4B). In such a case, some of the radiant heat of the heat source 93 is supplied directly to the heating area HA of the fixing belt 91 through the window 95*c*. Further, some of the radiant heat of the heat source 93 is reflected by the lower face of the shield members 95*a*1 and 95*a*2, and supplied to the heat conductor 92. Further, some of the radiant heat of the heat source 93 is supplied directly to the heat conductor 92.

After the fixing process, the CPU 307 drives a sheet ejection motor to rotate a sheet ejection roller 24, by which the transfer sheet P can be ejected outside the image forming apparatus 202 after the fixing process.

In the above-described configuration, the heat conductor 92 that can contact the inner face of the fixing belt 91 has thermal conductivity set higher than the thermal conductivity of the fixing belt 91. With such a configuration, the radiant heat of heat source 93 can be transmitted to the nip N, set between the fixing belt 91 and the pressure roller 94, via the heat conductor 92, and heat transmission from the heating area HA of the fixing belt 91 to a non-heating area of the fixing belt 91 can be suppressed. Accordingly, when the transfer sheet P of small size (e.g., smallest size) passes the nip N, temperature difference between the sheet-pass area for the fixing belt 91 (i.e., the heating area HA) and the sheet-not-pass area (i.e., the non-heating area) can be decreased.

Further, in the above-described configuration, a plurality of heaters may not need to be disposed even if the sheet width of the transfer sheet P is changed; and radiant heat can be efficiently transmitted to the nip N, set between the fixing belt 91 and the pressure roller 94, and the heating area HA without disposing a plurality of heaters. Accordingly, a size increase of the heating device can be prevented, and further a size increase of the fixing unit 9 can be prevented.

Further, in the above-described configuration, heat radiation to the sheet-not-pass area of the fixing belt 91 can be restricted by moving the shield members 95*a*1 and 95*a*2 in the sheet width direction. Accordingly, significant temperature increase at the sheet-not-pass area of the fixing belt 91 can be suppressed. Accordingly, deterioration of the surface layer of the fixing belt 91 and the pressure roller 94, which may be caused by significant temperature increase, can be prevented and thereby a longer service life can be attained. Further, instead of the above-described configuration, a heat pipe can be inserted inside the heat conductor 92 along a long side direction of the heat conductor 92. Such heat pipe may be made of a material having higher thermal conductivity, and volatile fluid (or operating fluid) is enclosed and sealed in the heat pipe. By inserting the heat pipe, heat transfer between the sheet-pass area and sheet-not-pass area of the fixing belt 91 can be generated by evaporation/condensation effect of the operating fluid, by which thermal conductivity of the heat conductor 92 can be enhanced. Especially, when the transfer sheet P of small size is processed at the fixing process, temperature distribution along the long side direction of the heat conductor 92 can be set more evenly, by which significant temperature increase at the sheet-not-pass area of the fixing belt 91 can be suppressed.

Further, in the above-described configuration, the shield members 95*a*1 and 95*a*2 may be made of aluminum-based material, for example, and the lower face of shield members 95*a*1 and 95*a*2 may be set as a reflection face. The reflection face has a heat reflectivity (or reflectance) of 95% or more, for example. Further, the upper face of shield members 95*a*1 and 95*a*2 may be formed as a heat-resistance layer such as a heat-resistance resin, a heat-resistance rubber, or a ceramic material, for example. In such case, radiant heat of the heat source 93 can be efficiently reflected to the heat conductor 92, and heat transfer from the heat source 93 to the fixing belt 91 can be effectively shielded. Accordingly, while using heat energy efficiently, the heating process can be conducted effectively even when the sheet width of the transfer sheet P changes. Further, because energy consumption can be reduced in the above-described configuration, a size increase of the heating device (e.g., heater) can be suppressed, and thereby a size reduction of the fixing unit 9 can be devised.

Further, such heat-resistance layer may include a "vacuum insulation layer" in its inside. Such vacuum insulation layer may be set to have an internal pressure of 1/500 or less of atmospheric pressure, for example. Accordingly, the heat-insulation effect of the shield members 95*a*1 and 95*a*2 can be enhanced.

Figure 6A:
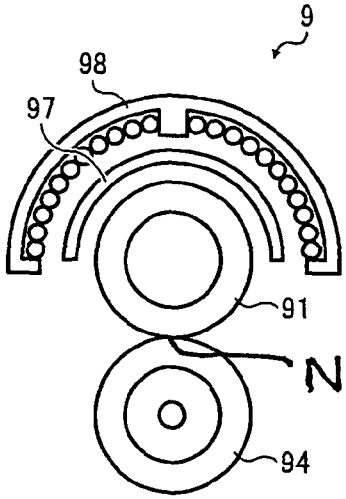
FIGS. 6A and 6B illustrate a cross-sectional view of a fixing unit according to a second example embodiment.
Figure 6B:
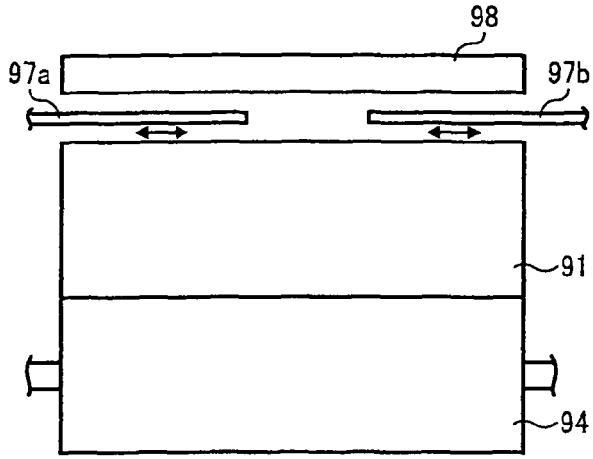

A description is now given to a. second example embodiment of the fixing unit 9 with reference to FIGS. 6A and 6B. FIG. 6A illustrates a cross-sectional view of fixing unit 9 in a radial direction, and FIG. 6B illustrates a cross-sectional view of fixing unit 9 in an axial direction. Different from the heat source 93 (e.g., heater) used for the first example embodiment, an electromagnetic heating unit 98 having an exciting coil is employed for the second example embodiment. Hereinafter, the same units or devices used in the first and second example embodiments are attached with the same reference names and numbers.

As shown in FIG. 6A, the fixing unit 9 includes the electromagnetic heating unit 98 facing an outer circumference of the fixing belt 91, and a magnetic-flux shield member 97 disposed between the fixing belt 91 and the electromagnetic heating unit 98. In such a configuration, a heatable surface layer formed as a surface layer of the fixing belt 91 can be heated by electromagnetic induction effect of the electromagnetic heating unit 98. The fixing belt 91 may include a metal core, an elastic layer, and a heatable surface layer formed on an outer face of the elastic layer.

As shown in FIG. 6B, the magnetic-flux shield member 97 may include two shield members 97*a* and 97*b* (or magnetic-flux shield members 97*a* and 97*b*), for example. The shield members 97*a* and 97*b* can be moved in an axial direction of the fixing belt 91 (or in the sheet width direction) with a guide effect of two guide rails, which may correspond to the guide rails 95*b* in FIGS. 3A and 3B. Each of the shield members 97*a* and 97*b* may be moved in the sheet width direction by using a drive unit. For example, such drive unit may be a solenoid unit having a magnet coil, a plunger, or the like disposed for each of the shield members 97*a* and 97*b*. By activating or deactivating the solenoid units (e.g., ON/OFF of solenoid), the shield members 97*a* and 97*b* can be spread apart, by which a window (which may correspond to the window 95*c*in FIG. 3A) can be set between the shield members 97*a* and 97*b*. Because the two guide rails are disposed in parallel with each other, a length size of the window in the sheet transport direction can be set to a constant value. On one hand, a length size of the window in the sheet width direction changes depending on a moving distance of the shield members 97*a* and 97*b*.

In such configuration, the length size of the window in the sheet width direction is set greater than the sheet width of the transfer sheet P, which passes the nip N. Accordingly, when the heatable surface layer of the fixing belt 91 is heated through the window, the size of the heating area HA in the sheet width direction, heatable by an electromagnetic induction effect of the electromagnetic heating unit 98, is set greater than the sheet width.

In the first example embodiment, the heat source 93 having a heater is used. In the second example embodiment, the electromagnetic heating unit 98 is disposed outside the fixing belt 91, by which the surface layer of the fixing belt 91 can be effectively and efficiently heated, wherein the surface layer of the fixing belt 91 may contact the transfer sheet P.

Further, in the second example embodiment, the electromagnetic heating unit 98 and the magnetic-flux shield member 97 can be disposed outside the fixing belt 91, by which a configuration of the fixing belt 91 can be simplified, by which maintenance work or replacement work of the fixing belt 91 or fixing unit 9 can be conducted easily.

Further, the fixing belt 91 can be supported and extended by a plurality of support members for the above-described example embodiments and the following example embodiments. Further, the electromagnetic heating unit 98 having an exciting coil can be disposed inside the fixing belt 91 having a heatable layer as an inner layer of the fixing belt 91, and the magnetic-flux shield member 97 can be disposed between the inner layer (or a heatable layer) of the fixing belt 91 and the exciting coil of the electromagnetic heating unit 98.

Figure 7:
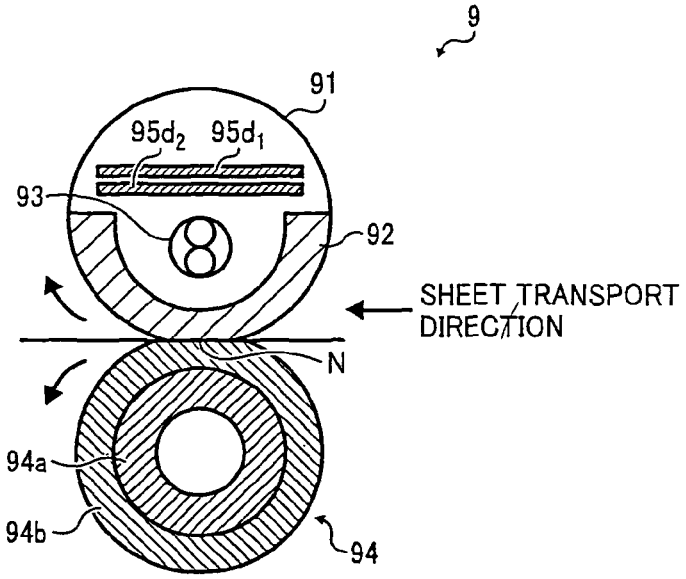
FIG. 7 illustrates a cross-sectional view of a fixing unit according to a third example embodiment.
Figure 8A:
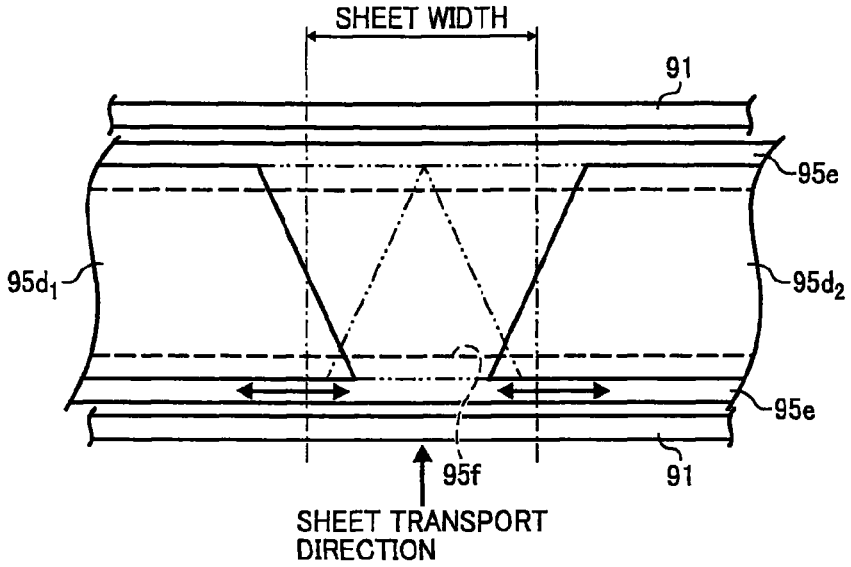
FIGS. 8A-8C illustrate a plan view and a cross-sectional view of a fixing unit according to a third example embodiment.
Figure 8B:
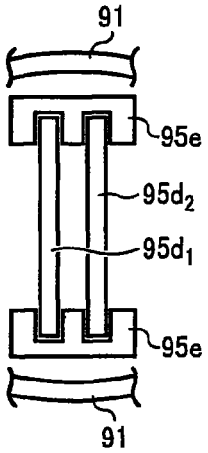
Figure 8C:
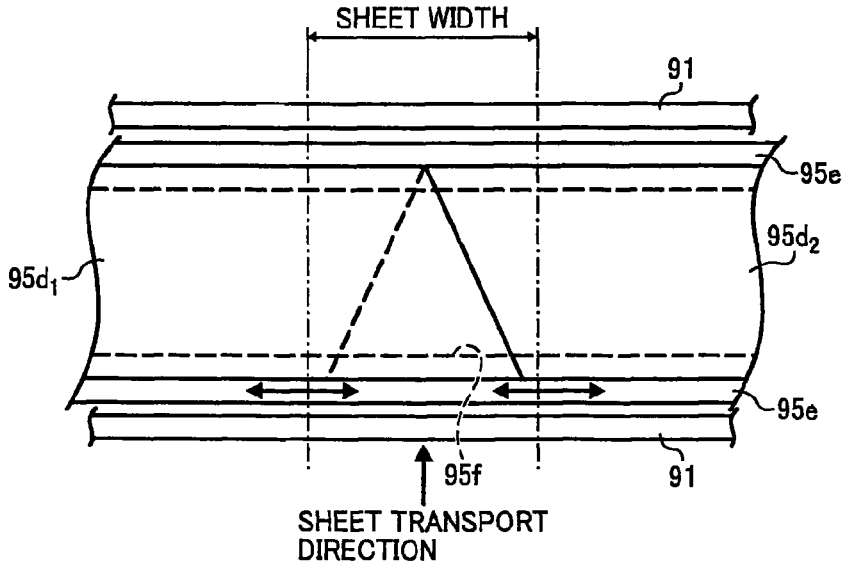
Figure 9:
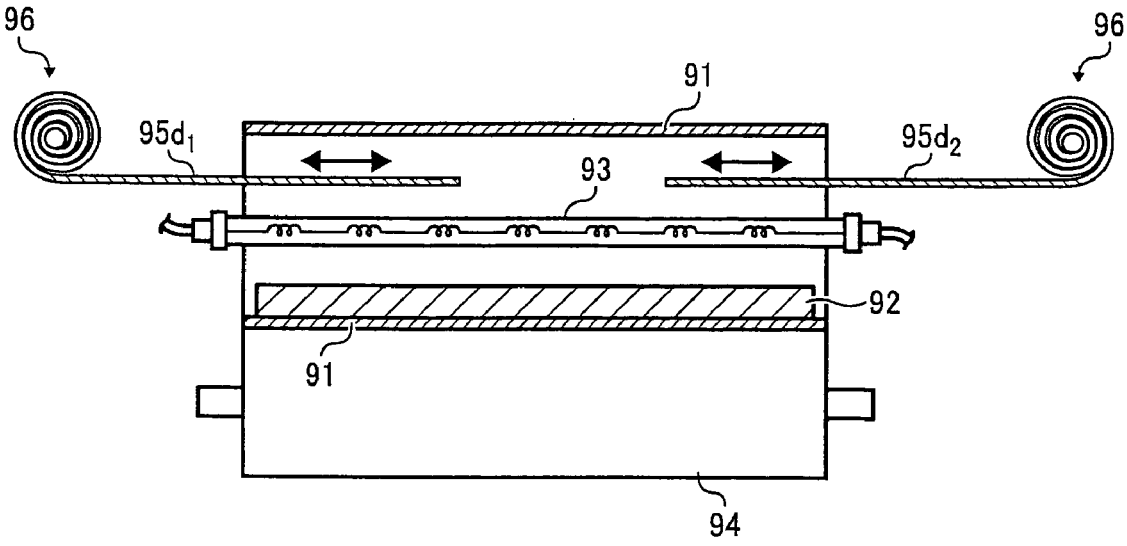
FIG. 9 illustrates a schematic view of a winding unit for a shield member according to a third example embodiment.

A description is now given to a third example embodiment of the fixing unit 9 with reference to FIGS. 7 to 9. In the third example embodiment, shield member has a different shape compared to the shield member used for the first example embodiment. FIG. 7 illustrates a cross-sectional view of fixing unit 9 in a radial direction, and FIGS. 8A to 8C illustrate cross-sectional views of fixing unit 9 in an axial direction and side direction. FIG. 9 illustrates a winding unit for the shield member. Hereinafter, the same units or devices used in the first and third example embodiments are attached with the same reference names and numbers.

In FIG. 7, the fixing belt 91 may be formed of a metal belt or a resin material belt. The fixing belt 91 has a separation layer as a surface layer. Such separation layer has a function of preventing toner adherence to the fixing belt 91 from the un-fixed toner on the transfer sheet P. The pressure roller 94 includes the metal roller 94*a*, and the elastic layer 94*b* formed on the metal roller 94*a*. The pressure roller 94 may be pressed to the fixing belt 91 using a spring or the like, and the elastic layer 94*b* is deformed against the fixing belt 91, by which the nip N having a given nip width is formed, and the nip N may be set to a flat condition.

Further, the fixing belt 91 may include two shield members 95*d*1 and 95*d*2, formed in a plate shape, inside the fixing belt 91, and the shield members 95*d*1 and 95*d*2 can move parallel to the sheet width direction. Further, each of the shield members 95*d*1 and 95*d*2 has an upper face and a lower face. The lower face (the lower face in FIG. 7) faces the heat source 93, and the upper face (the upper face in FIG. 7) faces the inner face of the fixing belt 91.

When the shield members 95*d*1 and 95*d*2 are moved in opposite directions and spread apart, a window 95*f* (see FIG. 8A) can be set between the shield members 95*d*1 and 95*d*2. Such window 95*f* is corresponded to the heating area HA of the fixing belt 91.

As shown in FIG. 8A, two guide rails 95*e* are set parallel to the sheet width direction, and each of the shield members 95*d*1 and 95*d*2 has a slanted edge side, slanted away from the sheet transport direction. Specifically, the slanted edge side of the shield members 95*d*1 and 95*d*2 is slanted in an upper-to-lower direction in FIG. 8A. Accordingly, when the shield members 95*d*1 and 95*d*2 are spread apart, and the window 95*f* is set, the window 95*f* may substantially become a trapezoid.

On one hand, when the window 95*f* is closed as shown in FIG. 8C, some part of the shield members 95*d*1 and 95*d*2 overlap each other. Such overlapped portion is shown as a dotted triangle in FIG. 8A, and the closed condition is shown in FIG. 8C.

Further, because the two guide rails 95*e* are disposed in parallel with each other, a length size of the window 95*f* in the sheet transport direction can be set to a constant value, wherein such length in the sheet transport direction may correspond to a height of the trapezoid shape of the window 95*f*.

On one hand, a length size of the window 95*f* in the sheet width direction changes depending on moving distance of the shield members 95*d*1 and 95*d*2, wherein such length in the sheet width direction corresponds to a upper or lower side of the trapezoid of the window 95*f*.

As shown in FIG. 8B, the two guide rails 95*e* may be formed as an upper guide rail and a lower guide rail. In such configuration, the shield members 95*d*1 and 95*d*2 may be set in different guide rails 95*e*, and the shield members 95*d*1 and 95*d*2 move along the different guide rails 95*e* in the sheet width direction. Accordingly, the shield members 95*d*1 and 95*d*2 can close the window 95*f* by overlapping the slanted edge sides of the shield members 95*d*1 and 95*d*2.

As shown in FIG. 9, the shield members 95*d*1 and 95*d*2 may be formed as a long film, and a winding unit 96 is employed to move the shield members 95*d*1 and 95*d*2 along the two guide rails 95*e*. Specifically, the shield members 95*d*1 and 95*d*2 can be rolled by the winding unit 96 to move the members 95*d*1 and 95*d*2 to enlarge the window 95*f*, and can be fed from the winding unit 96 to move the shield members 95*d*1 and 95*d*2 to decrease or close the window 95*f*. The winding unit 96 may include a winding roller, a winding motor, and a drive force transmission unit, for example. The shield members 95*d*1 and 95*d*2, formed as the long film may be wound on the winding roller. The winding motor is used as a drive unit to drive the winding roller in a given direction (normal-rotation direction, counter-normal-rotation direction). The drive force transmission unit may include a pulley, a gear, or the like to transmit driving force of the winding motor to the winding roller. The controller 300 and the CPU 307 may control the winding motor as similar to the above described solenoid unit.

When the window 95*f* is to be enlarged, the winding motor is rotated to the normal-rotation direction to wind the shield members 95*d*1 and 95*d*2 (long film) on the winding roller. When the window 95*f* is to be decreased, the winding motor is rotated to the counter-normal-rotation direction rotation, which is opposite to the normal-rotation direction rotation, to feed the shield members 95*d*1 and 95*d*2 (long film) from the winding roller. Further, the window 95*f* can be closed by feeding the shield members 95*d*1 and 95*d*2 (long film) until the above-described triangle area is set.

In the third example, the window 95*f* has a substantially trapezoid shape having an upper side and lower side parallel to each other, in which one of the upper side and lower side is set greater than other side because of the trapezoid shape. Such greater side is set longer or greater than the sheet width.

Accordingly, when radiant heat of the heat source 93 is supplied to the inner face of the fixing belt 91 through the window 95*f*, the size of the heating area HA in the sheet width direction, heatable by the radiant heat, is set greater than the sheet width. As the fixing belt 91 rotates toward the nip N, a different portion of the fixing belt 91 can be heated successively, by which an area of the heating area HA becomes greater in a direction perpendicular to the sheet width direction. Accordingly, especially, when the transfer sheet P of small size is processed at the fixing process, a sufficient amount of heat energy can be supplied to the sheet-pass area evenly.

Further, in the third example, the winding unit 96 having the winding motor is employed as a drive unit to move the shield members 95*d*1 and 95*d*2. Accordingly, the size of the window 95*f*, set between the shield members 95*d*1 and 95*d*2, can be adjusted continuously (or non-stepwisely).

Figure 10:
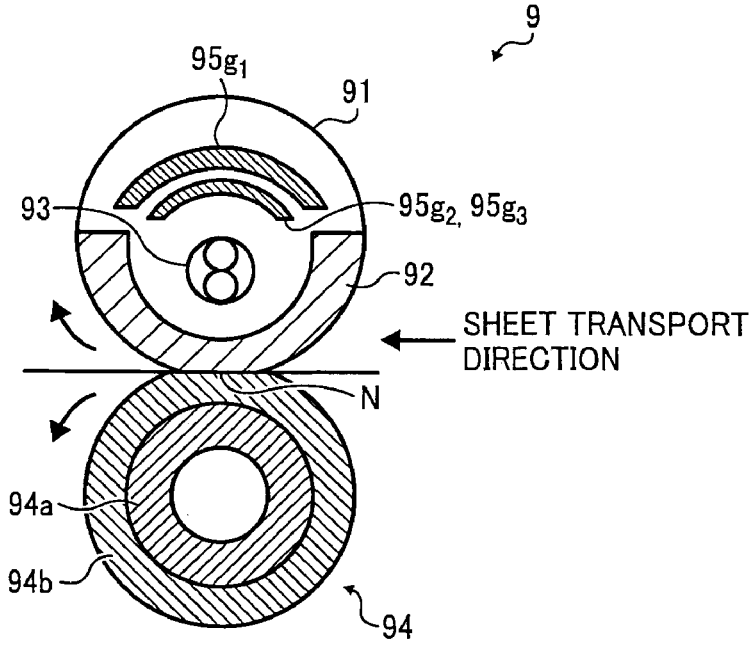
FIG. 10 illustrates a cross-sectional view of a fixing unit according to a fourth example embodiment.
Figure 11B:
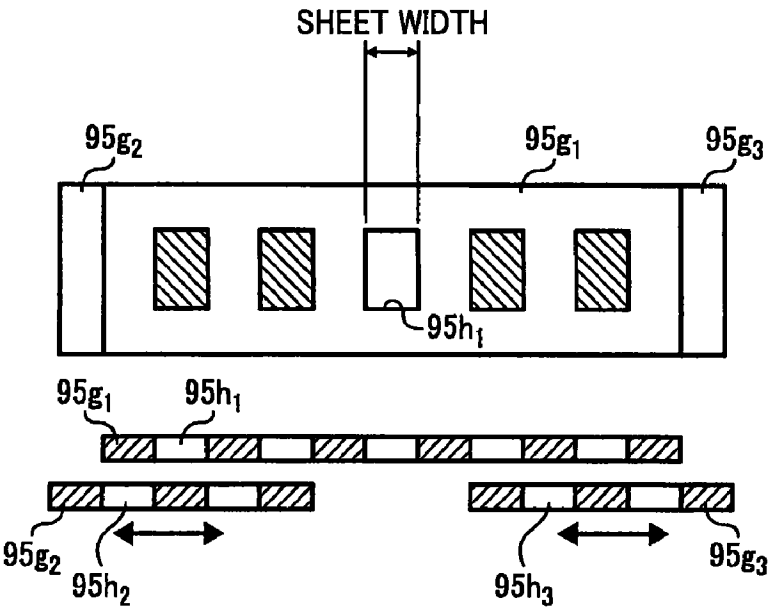
FIGS. 11A and 11B illustrate a plan view and a cross-sectional view of a shield member of FIG. 10.
Figure 11A:
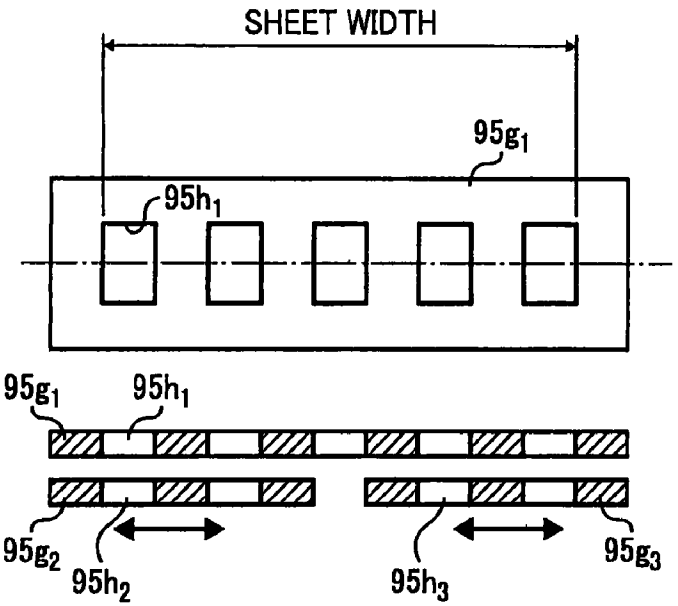

A description is now given to a fourth example embodiment of the fixing unit 9 with reference to FIGS. 10, 11A and 11B. In the fourth example embodiment, the shield member has a different shape compared to the shield member used for the first example embodiment. Specifically, [[a]] shield members 95*g*1, 95*g*2, and 95*g*3 have rectangular pass-through holes. FIG. 10 illustrates a cross-sectional view of fixing unit 9 in a radial direction, and FIGS. 11A and 11B illustrate cross-sectional views of fixing unit 9 in an axial direction and side direction. Hereinafter, the same units or devices used in the first and fourth example embodiments are attached with the same reference names and numbers.

In FIG. 10, the fixing belt 91 may be formed of a metal belt or a resin material belt. The fixing belt 91 has a separation layer as a surface layer. Such separation layer has a function of preventing toner adherence to the fixing belt 91 from the un-fixed toner on the transfer sheet P. The pressure roller 94 includes the metal roller 94*a*, and the elastic layer 94*b* formed on the metal roller 94*a*. The pressure roller 94 may be pressed to the fixing belt 91 using a spring or the like, and the elastic layer 94*b* is deformed against the fixing belt 91, by which the nip N having a given nip width is formed, and the nip N may be set to a flat condition.

Further, the fixing belt 91 may include three shield members 95*g*1, 95*g*2, and 95*g*3 in the fixing belt 91, wherein the shield members 95*g*1, 95*g*2, and 95*g*3 are formed in a curved shape, corresponding to a curved shape of the fixing belt 91 as shown in FIG. 10.

The first shield member 95g1 may be fixed in the fixing belt 91, and has an upper face and a lower face. The upper face of first shield member 95g1 (the upper face in FIG. 10) faces the inner face of the fixing belt 91, and the lower face (the lower face in FIG. 10) of first shield member 95g1 faces the second and third shield members 95g2 and 95g3.

The second and third shield members 95g2 and 95g3 can be moved in the sheet width direction using two guide rails, which corresponds to the guide rails 95b in FIGS. 3A and 3B. The second and third shield members 95g2 and 95g3 also have an upper face and a lower face. The upper face (the upper face in FIG. 10) of shield members 95g2 and 95g3 face the first shield member 95g1, and the lower face (the lower face in FIG. 10) of shield members 95g2 and 95g3 face the heat source 93 and the heat conductor 92.

As shown in FIG. 11, each of the shield members 95g1, 95g2, and 95g3 is formed with a plurality of rectangular pass-through holes (or oblong figured pass-through holes) in the sheet width direction. Each of rectangular pass-through holes has the same rectangular shape, and is formed with the same interval, for example. Specifically, the first shield member 95g1 is formed with the pass-through holes 95h1; the second shield member 95g2 is formed with the pass-through holes 95h2; and the third shield member 95g3 is formed with the pass-through holes 95h3.

When the pass-through holes 95h1 of first shield member 95g1 and the pass-through holes 95h2 and 95h3 of second and third shield members 95g2 and 95g3 are aligned with each other, an aligned window used for supplying the radiant heat of heat source 93 to the heating area HA of the fixing belt 91 can be set. Such aligned window can be changed stepwisely by changing the aligned area and position of the pass-through holes 95h1 95h2, and 95h3. The pass-through holes 95h1 and the pass-through holes 95h2 or 95h3 may be aligned completely or partially, for example.

As shown in FIG. 11A, when four pass-through holes 95h1, two pass-through holes 95h2, and two pass-through holes 95h3 are aligned, four aligned windows can be set by the pass-through holes 95h1 and the pass-through holes 95h2 and 95h3. Further, the pass-through hole 95h1 set at the center of first shield member 95g1 can be used as a window. Accordingly, five windows can be used to supply the radiant heat of heat source 93 to the heating area HA of the fixing belt 91. The heating area HA may correspond to the transfer sheet P of large size (e.g., largest size). In such a case, the temperature of the fixing belt 91 in the sheet width direction can be set substantially even.

As shown in FIG. 11B, the pass-through hole 95h1 at the center of first shield member 95g1 may have a length in the sheet width direction set greater than the sheet width of a transfer sheet. FIG. 11B shows a case that four pass-through holes 95h1, two pass-through holes 95h2, and two pass-through holes 95h3 are not aligned, and only the pass-through hole 95h1 at the center of first shield member 95g1 is used as a window. Accordingly, the radiant heat of heat source 93 can be supplied to the heating area HA of the fixing belt 91 through the pass-through hole 95h1 at the center of first shield member 95g1. The heating area HA may correspond to the transfer sheet P of small size (e.g., smallest size). In this case, the radiant heat of heat source 93 is not supplied to an area of the fixing belt 91, which corresponds to the area of the four pass-through holes 95h1, two pass-through holes 95h2, and two pass-through holes 95h3 shown in FIG. 11B. Such area may be referred to as a non-heating area of the fixing belt 91.

In such configuration shown in FIGS. 11A and 11B, the shield members 95g1, 95g2, and 95g3 have a lower face, and the lower face of the shield members 95g1, 95g2, and 95g3 may be formed as a reflection face except the pass-through holes 95h1, 95h2, and 95h3. With such a configuration, some of the radiant heat of heat source 93 can be reflected by the lower face of the shield members 95g1, 95g2, and 95g3, and then supplied to the heat conductor 92.

In the fourth example embodiment, when the second and third shield members 95g2 and 95g3 move in the sheet width direction, the pass-through holes 95h1, and the pass-through holes 95h2 and 95h3 may be aligned with each other. Accordingly, an area and position of the window to supply radiant heat of the heat source 93 to the heating area HA of the fixing belt 91 can be changed stepwisely. Accordingly, heat energy can be effectively and efficiently supplied to the fixing belt 91 and the pressure roller 94 depending on the sheet width of the transfer sheet P. Further, unnecessary energy consumption can be reduced with such configuration.

Further, in the fourth example embodiment, a length of the pass-through hole 95h1 at the center of first shield member 95g1 in the sheet width direction may be set greater than the sheet width. Accordingly, when the transfer sheet P of the small size is processed at the fixing process, a sufficient amount of heat energy can be supplied to the sheet-pass area evenly.

Figure 12B:
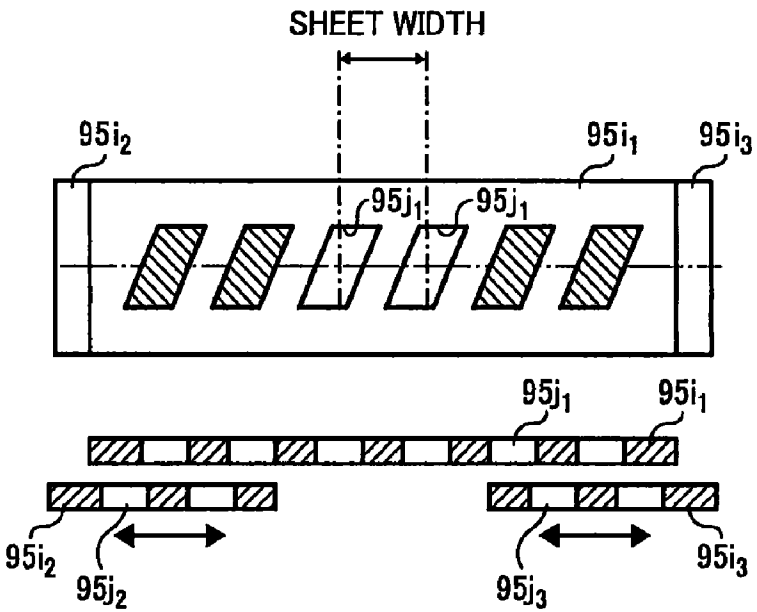
FIGS. 12A and 12B illustrate a plan view and a cross-sectional view of a shield member according to a fifth example embodiment.
Figure 12A:
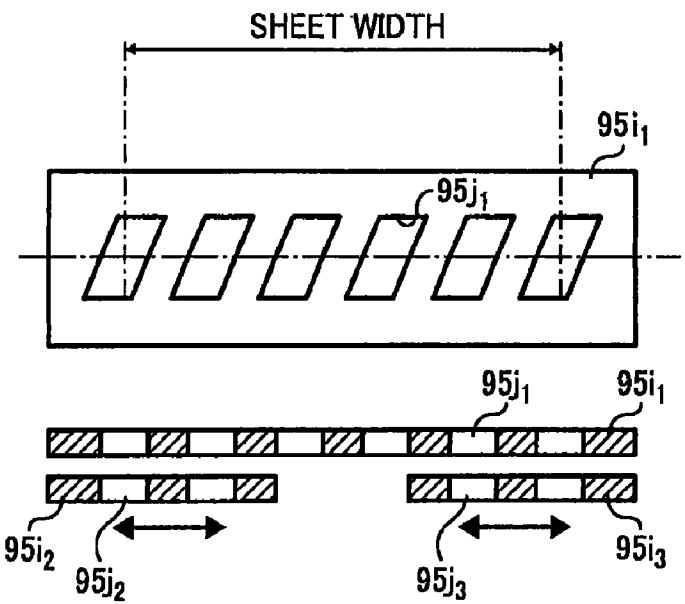

A description is now given to a fifth example embodiment of the fixing unit 9 with reference to FIGS. 12A and 12B. In the fifth example embodiment, the shield member has different shape compared to the shield member used for the first example embodiment. Specifically, a shield member 95i1, 95i2, and 95i3 have parallelogram-shaped pass-through holes. Hereinafter, same units or devices used in the first and fifth example embodiments are attached with the same reference names and numbers.

In the fifth example embodiment, the fixing belt 91 may include first, second, and third shield members 95i1, 95i2, and 95i3, wherein the shield members 95i1, 95i2, and 95i3 are formed in a curved shape, corresponding to a curved shape of the fixing belt 91. The first shield member 95i1 may be fixed in the fixing belt 91, and has an upper face and a lower face. The upper face (the upper face in FIG. 12) of first shield member 95i1 faces the inner face of the fixing belt 91, and the lower face (the lower face in FIG. 12) of first shield member 95i1 faces the second and third shield members 95i2 and 95i3.

The second and third shield members 95i2 and 95i3 can be moved in the sheet width direction along two guide rails, which correspond to the guide rails 95b in FIGS. 3A and 3B. The second and third shield members 95i2 and 95i3 have an upper face and a lower face. The upper face (the upper face in FIG. 12) of shield members 95i2 and 95i3 face the first shield member 95i1, and the lower face (the lower face in FIG. 12) of shield members 95i2 and 95i3 faces the heat source 93 and the heat conductor 92.

As shown in FIGS. 12A and 12B, each of the shield members 95i1, 95i2, 95i3 is formed with a plurality of pass-through holes shaped in parallelogram in the sheet width direction. Each of the pass-through holes has the same parallelogram shape, and is formed with the same interval, for example. Specifically, the first shield member 95i1 is formed with pass-through holes 95j1; the second shield member 95i2 is formed with pass-through holes 95j2; and the third shield member 95i3 is formed with pass-through holes 95j3. When the pass-through holes 95j1 of the first shield member 9511, and the pass-through holes 95j2 and 95j3 of the second and third shield members 95i2 and 95i3 are aligned with each other, an aligned window used for supplying the radiant heat of heat source 93 to the heating area HA of the fixing belt 91 can be set. The pass-through holes **95*j*1 and the pass-through holes 95*j*2 or 95*j*3** may be aligned completely or partially, for example.

As shown in FIG. 12A, when four pass-through holes **95*j*1, two pass-through holes 95*j*2, and two pass-through holes 95*j*3 are aligned, four aligned windows can be set by the pass-through holes 95*j*1 and the second and third pass-through holes 95*j*2 and 95*j*3. Further, two pass-through holes 95*j*1 at the center of the first shield member 95*i*1 can be used as windows. Accordingly, six windows can be used to supply the radiant heat of heat source 93 to the heating area HA of the fixing belt 91**. The heating area HA may correspond to the transfer sheet P of large size (e.g., largest size).

FIG. 12B shows a case that four pass-through holes **95*j*1, two pass-through holes 95*j*2, and two pass-through holes 95*j*3 are not aligned with each other, and only the two pass-through holes 95*j*1 at the center of first shield member 95*i*1 are used as windows. Accordingly, the radiant heat of heat source 93 can be supplied to the heating area HA of the fixing belt 91 through the two pass-through holes 95*j*1 at the center of first shield member 95*i*1**. The heating area HA may correspond to the transfer sheet P of small size (e.g., smallest size).

In such configuration shown in FIGS. 12A and 12B, an interval of adjacent pass-through holes **95*j*1, 95*j*2, and 95*j*3 is set equal to a length of an upper side (or lower side) of the parallelogram shape, wherein the upper side and lower side are parallel to each other. Further, as the fixing belt 91 rotates toward the nip N, different portions of the fixing belt 91 can be heated successively, by which an area of the heating area HA becomes greater in a direction perpendicular to the sheet width direction. Accordingly, the radiant heat of heat source 93 can be evenly supplied to the heating area HA of the fixing belt 91 even if the pass-through holes 95*j* are formed with such interval. Further, by moving the second and third shield members 95*i*2 and 95*i*3 in the sheet width direction, an end-to-end distance of window, formed by a combination of one or more windows set by the pass-through holes 95*j***, can be set greater than the sheet width of the transfer sheet P.

The shield members **95*i*1, 95*i*2, and 95*i*3 have the lower face. Except the pass-through holes 95*j*1, 95*j*2, and 95*j*3, the lower face of the shield members 95*i*1, 95*i*2, and 95*i*3 may be formed as reflection face. With such a configuration, some of the radiant heat of heat source 93 can be reflected by the lower face (used as the reflection face) of the shield members 95*i*1, 95*i*2, and 95*i*3, and then supplied to the heat conductor 92**.

In the fifth example embodiment, the interval of adjacent pass-through . holes **95*j*1, 95*j*2, and 95*j*3 is set equal to a length of an upper side (or lower side) of the parallelogram shape, wherein the upper side and lower side are parallel to each other. With such configuration, an uneven temperature condition, which may occur during the fixing process, can be prevented, and the transfer sheet P can be heated uniformly or evenly. If an uneven temperature condition occurs, an uneven heating condition may occur with a pitch of pass-through holes 95*j*1, 95*j*2, and 95*j*3**.

Further, in the fifth example embodiment, an end-to-end distance of the window, formed by a combination of one or more windows set by the pass-through holes **95*j*1, 95*j*2, and 95*j*3, can be set greater than the sheet-passing width of the transfer sheet P by moving the second and third shield members 95*i*2 and 95*i*3** in the sheet width direction. Accordingly, the size of the heating area HA in the sheet width direction can be set greater than the sheet width. Accordingly, especially, when the transfer sheet P of small size is processed at the fixing process, a sufficient amount of heat energy can be supplied to the sheet-pass area evenly.

In the first to fifth example embodiments, the fixing belt 91 is used as a fixing member, and the pressure roller 94 is used as a pressing member. However, a fixing roller can be used as a fixing member, and a pressure belt can be used as a pressing member in a similar manner. In such a case, the fixing roller may include a metal core made of aluminum-based material or iron-based material, and a heat-resistance layer coated on the metal core, for example. The heat-resistance layer may be made of heat-resistance resin material (e.g., fluorine resin) or heat-resistance rubber. Further, a heat- resistance resin (e.g., fluorine resin) layer may be coated on the heat-resistance rubber. The pressure belt may be made of heat-resistance rubber, or heat-resistance resin material, or may be made of multiple layers of heat-resistance rubber and heat-resistance resin, for example.

Further, in the first to fifth example embodiments, the transfer sheet P may have two sizes (e.g., large, small), but the transfer sheet P having medium size can be similarly used. For example, in the fourth and fifth example embodiments, shield members movable in the sheet width direction, a retracting unit (e.g., retracting rail), which retracts shield members not used for fixing process, can be added, and a drive unit (e.g., solenoid) can be added.

Further, in the above-described first, second, fourth, and fifth example embodiments, a solenoid unit is used as a drive unit for moving shield members or magnetic-flux shield members. However, a rack-and-pinion mechanism and a drive motor can be used as a drive unit. For example, a rack is disposed to the shield members, and the drive motor drives a pinion, engaged to the rack. With such a configuration, the shield members can be moved in the sheet width direction along the guide rails. Accordingly, the shield members can be moved in the sheet width direction continuously (or non-stepwisely).

In the above-described first to fifth example embodiments, in the fixing unit 9, the shield member can be moved in a space between the fixing belt 91 and the heat source 93 in the sheet width direction of the transfer sheet P to change a size of the window (e.g., **95*c* in FIG. 3A), by which the heating area HA on the inner face of the fixing belt 91 can be changed. Accordingly, the heating area HA can be changed in view of the sheet width of the transfer sheet P. Further, because the shield member can be moved in the sheet width direction of the transfer sheet P, a size of the window 95*c* in the sheet transport direction of the transfer sheet P may be limited, but a size of the window 95*c* in the transport direction of the transfer sheet P can be set in view of the size of the sheet. Accordingly, by moving the shield member, the heating area HA can be changed in view of the size of the sheet, by which a sufficient amount of heat energy can be supplied for the fixing process. By setting an appropriate heating area HA, the fixing belt 91 and the heat conductor 92 can be efficiently heated, and a size increase of the fixing unit 9** can be suppressed, wherein such size increase may occur in a radial direction of the fixing member of a conventional configuration.

In the above-described embodiments, the controller 300 may be used as transfer sheet P may be used as a recording medium; and the heat the sheet width detector; the fixing unit 9 may be used as the fixing device; the shield member, guide rails **95*b*, 95*e*, the winding unit 96, the magnetic-flux shield member 97 may be used as a heating area adjustor; the fixing belt 91 may be used as a fixing member; the heat source 93 having a heater, and the electromagnetic heating unit 98 may be used as a heating device; the conductor 92** may be used as a tensioning device.

In the above-described first to fifth example embodiments, in the fixing unit 9, an area on the fixing belt 91 heated through the window 95*c* may be set greater than the sheet width of the transfer sheet P. Accordingly, an edge portion of the sheet-pass area in the sheet width direction on the fixing belt 91 can be heated effectively. If such configuration is not employed, the window becomes smaller than the sheet width of the transfer sheet P, by which heat supplied to the fixing belt 91 may be absorbed at an edge portion of the transfer sheet P in the sheet width direction and the sheet-not-pass area of the fixing belt 91, by which the fixing process using sufficient heat energy may not be conducted.

In the above-described first, third, fourth, and fifth example embodiments, in the fixing unit 9, heat energy (radiant heat) of the heat source 93 is supplied to the heating area HA of the fixing belt 91 through the window set by the shield member. Further, some of radiant heat of the heat source 93 is directly supplied to the heat conductor 92 facing the heat source 93. Further, some of radiant heat of the heat source 93 is indirectly supplied to the heat conductor 92 via the shield member by reflecting radiant heat at the shield member. As such, the radiant heat of heat source 93 can be directly and indirectly supplied to the heat conductor 92, by which the fixing belt 91 can be effectively and efficiently heated by the heat conductor 92, contacting the fixing belt 91.

In the above-described first and third example embodiments, in the fixing unit 9, the two shield members 95*a*1 and 95*a*2 move relatively in the sheet width direction of the transfer sheet P. When the shield members 95*a*1 and 95*a*2 are spread apart, the window 95*c* is formed, and when the shield members 95*a*1 and 95*a*2 are abutted, the window 95*c* is closed. As above described, by changing a size of the window 95*c*, the heating area HA can be adjusted in view of the sheet width of the transfer sheet P.

In the above described embodiment, the shield members 95*a*1 and 95*a*2, 95*d*1, 95*d*2 may be used as a plurality of plate members; the solenoid unit and the winding unit 96 may be used as a drive unit; the window 95*c*, 95*f* may be used as window.

In the above-described fourth and fifth example embodiments, in the fixing unit 9, the first shield member 95*g*1, and the second and third shield members 95*g*2 and 95*g*3 move relatively in the sheet width direction of the transfer sheet P, by which the pass-through holes 95*h*1, the pass-through holes 95*h*2 and 95*h*3 may be aligned to form an aligned window, or the aligned window may be closed by changing relative positions of the pass-through holes. As above described, by changing a pattern of the aligned window, the heating area HA can be adjusted in view of the sheet width of the transfer sheet P.

Further, because the first shield member 95*g*1 having pass-through holes, and the second and third shield members 95*g*2 and 95*g*3 having pass-through holes are aligned to set the aligned window, a total size of the heating area adjustor configured with the first to third shield members 95*g*1-95*g*3 and the guide rail can be set smaller in length compared to a configuration using two plate shield members, extending in the sheet width direction, to set a window between the two plate shield members. Accordingly, a size increase of the fixing unit 9 can be suppressed.

In the above described embodiment, the shield members 95*g*1, 95*g*2, 95*g*3, 95*i*1, 95*i*2, 95*i*3 are used as a plurality of plate members; the pass-through holes 95*h*1, 95*h*2, and 95*h*3, 95*j*1, 95*j*2, 95*j*3 are used as holes to set a window or an aligned window. For example, in FIG. 11A, the pass-through hole 95*h*1 at the left end of the first shield member 95*g*1 and the pass-through hole 95*h*2 at the left end of the second shield member 95*g*2 are aligned to set an aligned window.

In the above-described first to fifth example embodiments, the image forming apparatus 202 includes the image forming engine 305 to form a toner image on the transfer sheet P, and the above-described fixing unit 9 to fix an un-fixed toner image on the transfer sheet P. Such fixing unit 9 can be effectively used to reduce energy consumption for the fixing process while being capable of using the transfer sheet P having various sheet width. Further, such fixing unit 9 can be effective to suppress a size increase of the image forming apparatus 202.

In the above-described embodiments, the engine control board 304 and the image forming engine 305 may be used as an image forming unit; and the image forming apparatus 202 may be used as an image forming apparatus.

In the above-described embodiments, a fixing unit includes a fixing member, a heating device, and a heating area adjustor. The heating area adjustor, disposed in a space between the fixing member and the heating device, includes shield members which can move in a sheet width direction of the recording medium so that a heating area of the fixing member is adjustably changed depending on types of recording medium (e.g., sheet width). Such configuration can preferably reduce energy consumption of the fixing unit and an image forming apparatus employing such fixing unit.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined with each other and/or substituted for each other within the scope of this disclosure and appended claims.

What is claimed is:

1. A fixing unit comprising:

a fixing member;

a pressing member to face the fixing member to form a fixing nip between the fixing member and the pressing member, an un-fixed toner image being fixed on a recording medium when the recording medium passes through the fixing nip;

a heating device to heat the fixing member while maintaining a non-contact condition with a surface of the fixing member;

a sheet width detector to detect a sheet width of the recording medium to pass through the fixing nip; and a heating area adjustor to change a heating area of the fixing member heatable by the heating device, based on the sheet width detected by the sheet width detector;

wherein the heating area adjustor is moveable in a space between the fixing member and the heating device in a sheet width direction to change a size of the heating area.

2. The fixing unit according to claim 1, wherein the heating area adjustor sets the size of the heating area of the fixing member greater than the sheet width of the recording medium in the sheet width direction.

3. The fixing unit according to claim 1, wherein the heating device is disposed inside the fixing member.

4. The fixing unit according to claim 1, wherein the fixing member is a fixing belt.

5. The fixing unit according to claim 4, further comprising a tensioning device to contact an inner face of the fixing belt to press the fixing belt to the pressing member.

6. The fixing unit according to claim 1, wherein the heating area adjustor includes a plurality of movable shield members and a drive unit that moves each of the plurality of movable shield members in relative directions in the sheet width direction, and wherein the plurality of movable shield members, when spread apart in the sheet width direction by the drive unit, define a window of adjustable size to adjustably change the heating area of the fixing member heatable by the heating device.

7. The fixing unit according to claim 6, wherein each of the plurality of movable shield members has a slanted edge face slanting away from a sheet transport direction, and the slanted edge faces of the plurality of movable shield members are used to set the window.

8. The fixing unit according to claim 1, wherein the heating area adjustor includes a plurality of shield members, each of the plurality of shield members includes a plurality of pass-through holes in the sheet width direction, and the plurality of shield members is stackingly arranged in the heating area adjustor, and wherein the plurality of shield members, when spread apart in the sheet width direction by a drive unit, aligning the pass-through holes of the plurality of shield members to define one or more windows of adjustable size to adjustably change the heating area of the fixing member heatable by the heating device.

9. The fixing unit according to claim 8, wherein each of the pass-through holes is a parallelogram.

10. The fixing unit according to claim 9, wherein each of the pass-through holes having a parallelogram shape has first and second sides of identical length disposed parallel to each other and to the sheet width direction, and a distance between adjacent pass-through holes disposed in the sheet width direction is equal to the length of the first and second sides.

11. An image forming apparatus, comprising:

an image forming unit to form an un-fixed toner image on a recording medium; and a fixing unit according to claim 1 to fix the un-fixed toner image on the recording medium.

12. The image forming apparatus according to claim 11, wherein the heating area adjustor sets the size of the heating area of the fixing member greater than the sheet width of the recording medium in the sheet width direction.

13. The image forming apparatus according to claim 11, wherein the heating device is disposed inside the fixing member.

14. The image forming apparatus according to claim 11, wherein the fixing member is a fixing belt.

15. The image forming apparatus according to claim 14, further comprising a tensioning device to contact an inner face of the fixing belt to press the fixing belt to the pressing member.

16. The image forming apparatus according to claim 11, wherein the heating area adjustor includes a plurality of movable shield members and a drive unit that moves each of the plurality of movable shield members in relative directions in the sheet width direction, and wherein the plurality of movable shield members, when spread apart in the sheet width direction by the drive unit, define a window of adjustable size to adjustably change the heating area of the fixing member heatable by the heating device.

17. The image forming apparatus according to claim 16, wherein each of the plurality of movable shield members has a slanted edge face slanting away from a sheet transport direction, and the slanted edge faces of the plurality of movable shield members are used to set the window.

18. The image forming apparatus according to claim 11, wherein the heating area adjustor includes a plurality of shield members, each of the plurality of shield members includes a plurality of pass-through holes in the sheet width direction, and the plurality of shield members is stackingly arranged in the heating area adjustor, and wherein the plurality of shield members, when spread apart in the sheet width direction by a drive unit, aligning the pass-through holes of the plurality of shield members to define one or more windows of adjustable size to adjustably change the heating area of the fixing member heatable by the heating device.

19. The image forming apparatus according to claim 18, wherein each of the pass-through holes is a parallelogram.

20. The image forming apparatus according to claim 19, wherein each of the pass-through holes having a parallelogram shape has first and second sides of identical length disposed parallel to each other and to the sheet width direction, and a distance between adjacent pass-through holes disposed in the sheet width direction is equal to the length of the first and second sides.

21. A fixing unit, comprising:

a fixing member;

a pressing member to face the fixing member to form a fixing nip between the fixing member and the pressing member, an un-fixed toner image being fixed on a recording medium when the recording medium passes through the fixing nip;

a heater to heat the fixing member by radiant heat while maintaining a non-contact condition with a surface of the fixing member; and a shield member to change a heating area of the fixing member heatable by the heater, based on a sheet width of the recording medium to pass through the fixing nip;

wherein the shield member is moveable in a space between the fixing member and the heater to change a size of the heating area, and wherein a first face of the shield member is configured to reflect the radiant heat of the heater.

22. The fixing unit according to claim 21, wherein the heater is disposed inside the fixing member.

23. The fixing unit according to claim 21, wherein the fixing member is a fixing belt.

24. The fixing unit according to claim 21, wherein the fixing nip is shaped in a flat shape.

25. The fixing unit according to claim 21, wherein the shield member is formed in a plate shape.

26. The fixing unit according to claim 21, wherein a second face of the shield member is formed as a heat-resistance rubber layer.

27. The fixing unit according to claim 21, wherein a second face of the shield member is formed as a ceramic layer.

28. The fixing unit according to claim 21, wherein a second face of the shield member is formed as a heat-resistance resin layer.

29. The fixing unit according to claim 21, further comprising:

a guide member;

wherein the guide member is configured to guide a moving direction of the shield member.

30. An image forming apparatus, comprising:

an image forming unit to form an un-fixed toner image on a recording medium; and a fixing unit according to claim 21 to fix the un-fixed toner image on the recording medium.

31. The fixing unit according to claim 21, wherein the shield member is made of aluminum-based material.

32. The fixing unit according to claim 21, wherein the first face of the shield member has heat reflectivity of 95% or more.

33. The fixing unit according to claim 21, wherein the shield member is formed with an open window.

34. The fixing unit according to claim 21, wherein the shield member is curved along a curving of the fixing member.

35. The fixing unit according to claim 21, wherein the fixing unit includes a drive unit that moves the shield member.

* * * * *